US008133121B2

(12) United States Patent
Hartmann et al.

(10) Patent No.: US 8,133,121 B2
(45) Date of Patent: Mar. 13, 2012

(54) SYSTEM AND PROCESS FOR STACKING ELECTRONIC GAME TABLES

(75) Inventors: Andreas Hartmann, Gibtralar (GI); Paul Fraser, Estepona Malaga (ES); Gavin O'Reilly, Gibraltar (GI); Kiran Kumar Potladurthi, Hyderabad (IN)

(73) Assignee: PartyGaming IA Limited, Hamilton (BM)

( * ) Notice: Subject to any disclaimer, the term of this patent is extended or adjusted under 35 U.S.C. 154(b) by 295 days.

(21) Appl. No.: 12/611,536

(22) Filed: Nov. 3, 2009

(65) Prior Publication Data

US 2011/0105224 A1 May 5, 2011

(51) Int. Cl.
*A63F 9/24* (2006.01)

(52) U.S. Cl. ..... 463/42

(58) Field of Classification Search ..... 463/42
See application file for complete search history.

(56) References Cited

U.S. PATENT DOCUMENTS

| | | | | |
|---|---|---|---|---|
| 7,780,512 | B2 * | 8/2010 | Sines et al. | 463/13 |
| 2006/0121973 | A1 | 6/2006 | Parisien | |
| 2008/0132312 | A1 * | 6/2008 | Yoshizawa | 463/16 |
| 2008/0161099 | A1 * | 7/2008 | Sines et al. | 463/20 |
| 2008/0176618 | A1 * | 7/2008 | Toompere | 463/16 |
| 2008/0254881 | A1 * | 10/2008 | Lutnick et al. | 463/31 |
| 2008/0268939 | A1 * | 10/2008 | Sines et al. | 463/20 |
| 2010/0311488 | A1 * | 12/2010 | Miller et al. | 463/16 |
| 2010/0312625 | A1 * | 12/2010 | Miller et al. | 705/14.5 |

FOREIGN PATENT DOCUMENTS

| | | | |
|---|---|---|---|
| WO | 2008008072 | A1 | 1/2008 |
| WO | 2008012594 | A1 | 1/2008 |

OTHER PUBLICATIONS

International Searching Authority, ISA/EP, International Search Report and Written Opinion for International Application PCT/EP2009/064556; ISR Mailing Date Jul. 21, 2010; 12 pages.

* cited by examiner

*Primary Examiner* — Pierre E Elisca
(74) *Attorney, Agent, or Firm* — Beem Patent Law Firm

(57) ABSTRACT

A system and process for aggregating and displaying information about a plurality of gaming tables to a user comprising a stacking component and a console area. The console area displays one or more active tables, while the stacking component displays changing information about each table the user has open. The stacking component may include one or more sub-components or dialogs, including a table list dialog, a player information dialog, a hand information dialog and/or an action area dialog.

21 Claims, 31 Drawing Sheets

154

156

110

(Beta) Stacking Window

| # | Players | Stakes/Game | Cards/Status | Pos/Time |
|---|---|---|---|---|
| 1 | 5<br>10/10 | $.50/1<br>Hold'em - NL | 9 K | D+2<br>10 |
| 2 | 9<br>5/6 | $1/2<br>Hold'em - FL | 9 K 4 K 4 | D+4 |
| 3 | 8/10 | $1/2<br>Hold'em - PL | Folded | |
| 4 | 5<br>4/6 | $.50/1<br>Hold'em - NL | 9 K 9 K 4 | D+4<br>13 |
| 5 | 4<br>9/10 | Tour - $640<br>Hold'em - NL | 9 K | SB<br>6 |
| 6 | 6<br>6/6 | $.25/.50<br>Hold'em - NL | 9 K 9 K 4 | D |
| 7 | 2<br>1/2 | $.25/.50<br>Hold'em - NL | 9 K 9 K 4 4 | D |
| 8 | 2<br>2/2 | $.25/.50<br>Hold'em - NL | 9 K 9 K 4 4 K | D+5<br>22 |
| 9 | 9<br>9/10 | $.25/.50<br>Hold'em - NL | 9 K 9 K 4 4 K | D+8 |
| 10 | 9<br>10/10 | $.25/.50<br>Omaha/Hi-Lo | 9 K 4 4 9 K | D<br>11 |
| 11 | 9<br>10/10 | $.25/.50<br>Omaha/Hi-Lo | 9 K 4 4 9 K 4 4 K | D+2 |
| 12 | 6<br>8/8 | $.50<br>Stud - Hi/Lo | 9 K 4 9 | D+1 |
| 13 | 3<br>7/8 | $.50<br>Stud - Hi/Lo | 9 K 9 K 4 9 4 | D+4<br>23 |
| 14 | 8/10 | $1/2<br>Hold'em - PL | I am back | |

FIG. 30

SYSTEM AND PROCESS FOR STACKING ELECTRONIC GAME TABLES

BACKGROUND OF THE INVENTION

1. Field of the Invention

The present invention is directed to a system and process for stacking electronic game tables, specifically, for organizing and displaying multiple poker-type game tables.

2. Description of the Related Art

Electronic gaming, particularly in the area of poker, is widely played and is experiencing a growth in popularity in recent times. Through the use of the Internet, online poker tables allow individuals around the world to play against one another. One of the benefits of these online tables is that a single player may be able to "sit" at multiple tables, playing or observing, and also may be able to wait for room to open at still other tables, all at the same time.

In order to accommodate the player's ability to have multiple tables open at the same time, attempts have been made to organize the tables so that the player can keep them straight. One organizational attempt involves tiling the tables across a screen. Although each open table is visible to the player at the same time, this method causes the table sizes to diminish as more tables are opened in order to fit them all on one screen, making the information on each table harder to read or follow. In addition, the vast amount of information that is displayed to the player may make it difficult for the user to distinguish tables where the player has strong hands or where the player should be focusing his or her attention.

Another attempt to organize the tables has involved cascading open tables so that only one or a select few of the tables are visible at once. While these tables are not miniaturized as much as tiled tables, they may make it difficult for the player to keep track of the action at each open table. This may be especially true if the player moves tables around on the monitor and then has to remember what table was placed where.

What is needed is a table organizational system or process that overcomes the drawbacks described above.

BRIEF SUMMARY OF THE INVENTION

In one aspect of the invention, a process operable on one or more computers for arranging a plurality of game tables, the tables including changing information, comprising: displaying an active table; displaying a stacking component that provides at least a subset of the changing information about each of the plurality of game tables; updating the changing information on the tables; and updating the subset on the stacking component as the changing information changes. The stacking component may include alerts displayed in a table list sub-component to tables for which action is required. The stacking component also may include a player information sub-component and/or at least one of a hand information sub-component and an action area sub-component.

In addition, the stacking component may include a grid for organizing and displaying information pertaining to the plurality of tables, such that selecting a row corresponding to one of the tables displays that table. The grid may include a row of headers corresponding to different subsets of information about each of the tables, and selecting a header may arrange the tables in the grid according to the header.

In another aspect of the invention, a system for organizing a plurality of electronic game tables, comprising: a game server in communication with a plurality of remote client computers, each of said remote client computers including a display; and at least one display including a console area and a stacking component area, wherein the console area displays an active table, and further wherein the stacking component area aggregates and displays information about the plurality of electronic game tables. The stacking component area may comprise: a table list sub-component, a player information sub-component, a hand information sub-component and/or an action area sub-component.

The stacking component may present a player with information pertaining to each of the tables, allow the player to select a table, make it an active table, and display the table in the console area, and allow the player to act on a non-active table without displaying the non-active table in the console area. In addition, the stacking component may display information about a table not displayed in the console area, wherein a portion of the displayed information changes before each hand played at the table and a second portion of the displayed information changes dynamically as each hand is played at the table.

In still another aspect of the invention, an electronic game table stacking component, comprising a table list sub-component and a player information sub-component, the table list sub-component including a grid for displaying a plurality of categories of information about a plurality of game tables opened by a player; the player information sub-component including information about a plurality of players at a selected one of the plurality of game tables. The table list sub-component may include an indicator for the selected game table. Moreover, the stacking component may allow a player to act indirectly on a desired table by taking action in the stacking component instead of on the table. The stacking component further may include one or both of a hand information component and an action area component. Additionally, the stacking component may include an indicator notifying the player of tables for which action is needed and may display relative priorities for said tables, i.e., so as to alert the player to tables for which action may be needed more imminently.

The stacking component may be linked to a console area that displays an active game table. In addition, one or more of the following may be the categories of information displayed in the table list sub-component: number of players seated; type of game being played; stakes involved; player's position in the hand; time remaining to act; hole cards; and community cards.

These and other features and advantages are evident from the following description of the present invention, with reference to the accompanying drawings.

BRIEF DESCRIPTION OF THE SEVERAL VIEWS OF THE DRAWINGS

FIG. 30 is a screenshot of yet another exemplary large stacking component layout.

DETAILED DESCRIPTION

Figure 1:
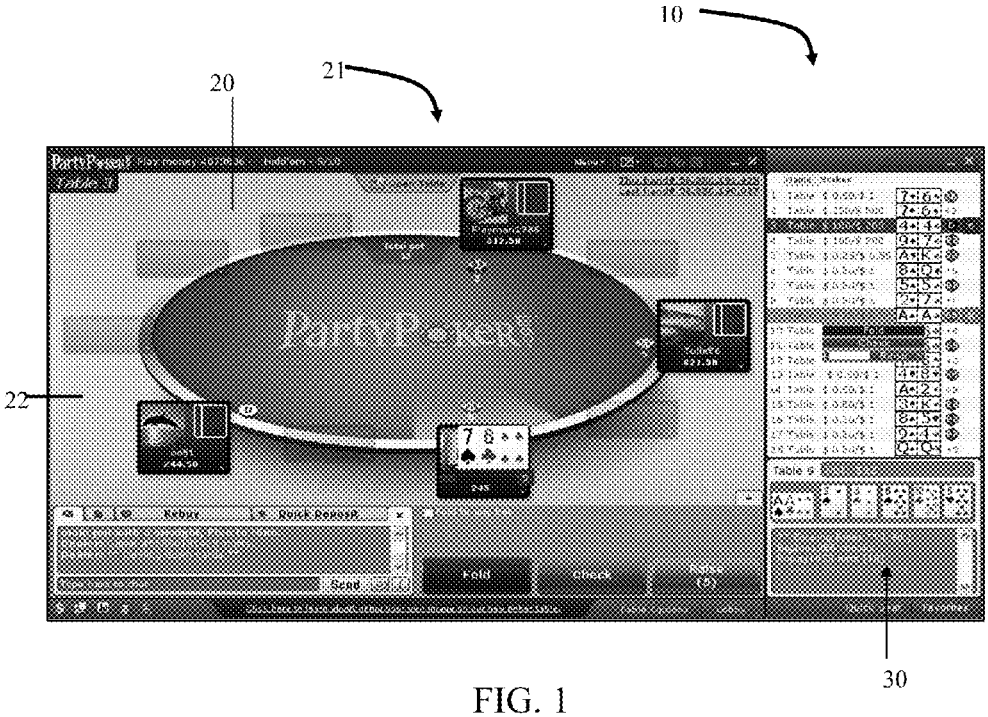
FIG. 1 is a screenshot of an exemplary layout showing a stacking component displayed alongside a game table.

A stacking system 10 provided at the client side of gaming application for aggregating and displaying information about a plurality of gaming tables 20 to a user.

This table stacking helps a player playing on multiple tables 20 by providing a summary of all tables 20 in one screen, display or similar presentation, and by providing easy access to the tables 20. It aims to make playing on more than one table easier, allowing players to manage more than one table 20 at the same time and to play more tables comfortably. It also facilitates the game play by providing option buttons, e.g., by right clicking a table row or via other access methods.

Table stacking aims to enable players to mange more than one table 20 using a new console interface known herein as a "stacking window" 30. The stacking window 30 may present the player with information held on the table 20 and may allow the player to look at a summary of the information at any table 20, bring a selected table 20 to the front of the stack 22, or right click or otherwise take available actions at the table 20 without bringing that table forward. The stacking window 30 may allow a player to see information about a plurality of tables quickly and easily so that the player may make actions on those tables in a traditional sense by calling each table forward. Alternatively, the stacking window 30 may display all relevant information about each table to a player and allow the player to act directly in the stacking window 30 so that the traditional table views may be unnecessary.

Table stacking allows a player to open up a plurality of tables 20 that are then stacked on top of each other, hidden so that only one active table is displayed, or otherwise arranged, allowing for player control via a stacking window 30. The player may open as many tables as desired, up to a predetermined limit. In one embodiment, this limit may be between about 10 and about 30 tables, preferably between about 15 and about 25 tables, more preferably about 18 tables. A stacking window 30 can fit details about each of the 18 tables in its table list, thereby allowing the player to play on 18 tables at a time.

Some of the benefits associated with stacking may include: constant overview of all of a player's hands; ease of navigation and management of multiple tables; ease of folding unwanted hands; allowing a player to focus on premium or hot hands; and ease of action, e.g., by double left-clicking on a selected table to bring it into focus and right-clicking to act.

In the embodiment shown in FIG. 1, multiple tables 20 may be stacked on top of each other, although the tables may be positioned in any layout desired by the player. In addition, a detachable table stacking window 30 may be provided separate from the stacked tables 22. Here, the table stacking window 30 is located to the right of the tables 22, although the window may be moved or located in a different position. If the player double clicks on a table in the stack 22 of tables, the selected table may be brought into focus in the console area 21.

Figure 2:
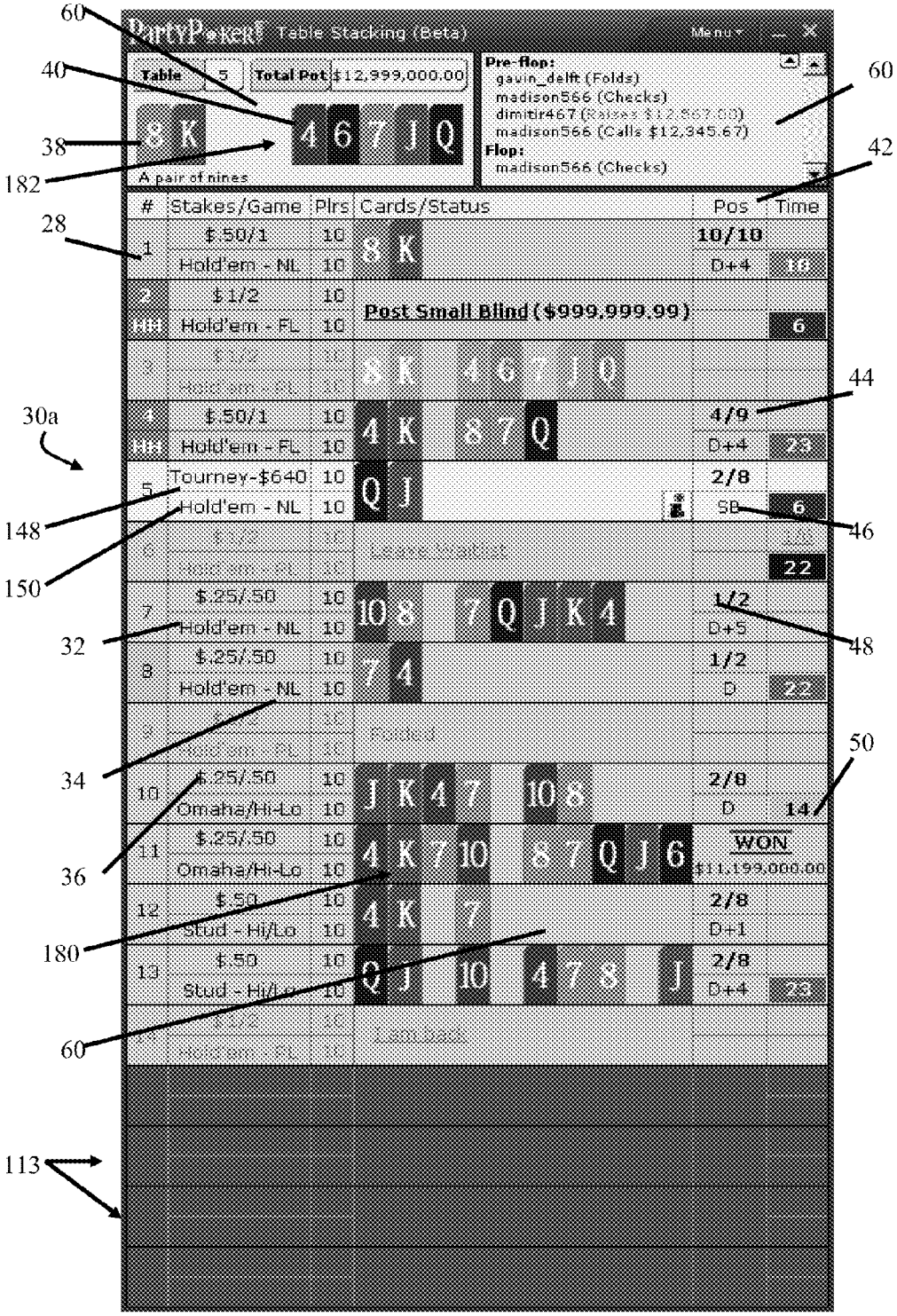
FIG. 2 is a screenshot of an exemplary large stacking component.

The table stacking window 30 may list all the tables 20 in the order in which they were opened, although the system 10 may allow for the user to rearrange or reorganize this order. As seen in FIG. 2, the table number, name, stakes, and time to act may be displayed in the window, as may the player's cards and position at each table. The stacking window may comprise several elements, including:

The Table Grid displaying:

Table Number 28;

Game type 32, limit type 34 and stakes 36 for cash games and tournament name and buy-ins for tournaments;

The hole cards 38, if dealt;

The community cards 40, if dealt;

The position notation 42, which comprises 3 pieces of information;

The number of people to who are active in the hand 44 (have met the current betting requirements to stay in the hand); the player's position relative to the dealer 46; and the number of players to act after the player (empty seats or players sat out are not counted—only active players are counted); and Timers 50—color coded timers indicating how long the players have left to act at any given table.

Stacking Component: This is regarded as the whole stacking component 30 whether it is large 30*a* or small 30*b* or broken down into separate dialogs or sub-components 60. There may be various sizes of stacking components to convey information to the player, the information preferably including the elements described above.

Large Stacking Component: The Large Stacking component 30*a* refers to the larger of the two supported stacking views. This component may have a predetermined width to display predetermined sets of changing data to the user. However, the minimum height may be determined by the number of sub-components 60 embedded into it, and the overall height may be determined by the layout type and the number of open tables 20. One example of this large stacking component 30*a* may be seen in FIG. 2.

Small Stacking Component: The Small Stacking component 30*b* refers to the smaller of the two supported stacking views. Similar to the large stacking component 30*a*, this small stacking component 30*b* may have a predetermined width to display predetermined sets of changing data to the user, although the width may be different than for the large stacking component 30*a*. The minimum height is determined by the number of sub-components 60 embedded into it and whether the player chooses to display those sub-components 60. For example, if the Hand Information sub-component (discussed below) is minimized, the stacking component may become dynamically smaller in height. One example of this small stacking component 30*b* may be seen in FIG. 3.

The small stacking component 30*b* may be used by players who wish to use a large number of tables 20 and who want to use this component as a reference tool rather than a decision making tool. Players may use this component to flag tables needing their attention and consequently reduce decisions on non-important tables.

Figure 4:
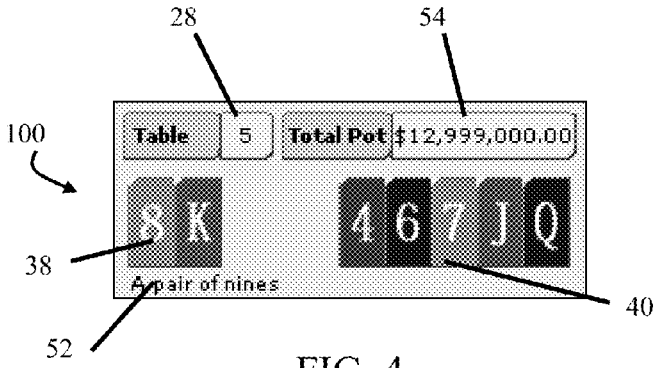
FIG. 4 is a screenshot of an exemplary console sub-component.

Large Stacking Component Dialogs: Some or all sub-components may be de-dockable and appear as standalone dialogs. Several of these sub-components or dialogs are discussed as follows:

Console Component: This sub-component shows the player 38 and community cards 40, the table number 28, the card strength 52 and the total pot value 54. One example of this console component may be seen in FIG. 4.

The console component 100 may include the following elements: Table Number 28, Total Pot amount 54, Hole Cards 38, Community Cards 40 (Hold'em & Omaha), Hand Strength 52, and potentially a timer 50, although this may be placed in an action area sub-component.

The total pot value 54 may be the value of the total pot on the active table. This value may be displayed in one manner generally and may be displayed in a different manner when there are side pots on the table, e.g., the pot value may be displayed in a different color if side pots are present. The presence of one or more side pots may be represented with a side pot indicator, whereby hovering over the indicator may display the number and amount of the side pot(s).

The system 10 may include a plurality of possible ways to display the cards that have been dealt. Examples of these different "decks" are discussed below.

The console component 100 may be "linked" to the action area if the action area is displayed. This linking may involve merging or joining the two sub-components so that they appear as one combination, both visually and technically creating a direct relationship between the sub-components.

If a player acts based on the action buttons, these actions preferably are related to the table 20 referred to in the console area 100 and are not necessarily related to the table 'in focus.'

Table List Component: This sub-component shows the table pertinent information of the tables 20 that the player has open (playing or watching) and all the cards shown at the tables as well as other information such as time to act and position. The height of this component may be determined by the number of tables 20 the player has opened. However, in one embodiment, a minimum of 8 rows 112 may be displayed no matter how many sub components 60 are chosen. The system 10 may allow the player to rearrange the order of the tables, i.e., the rows 112 and further may allow the player to choose what columns 114 to display and the order in which those columns 114 will be displayed.

Figure 5:
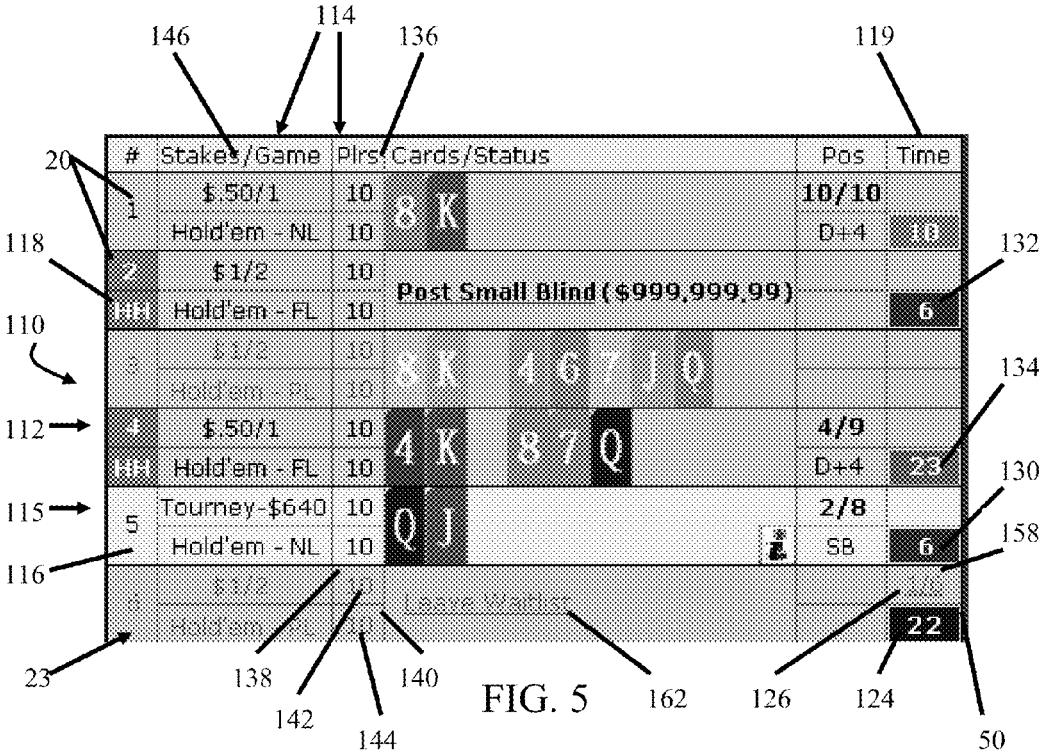
FIG. 5 is a screenshot of an exemplary table list sub-component.

One example of the table list component 110 may be seen in FIG. 5. As seen in this figure, several columns 114 may contain split rows 112, the split rows allowing the system 10 to convey more information to the player in a given space. In addition, this figure shows that the system 10 may include an active row or active table indicator 116 to alert the player to the table 20 that currently is being played or is being displayed in the console area 21. In this embodiment, the indicator 116 may comprise the use of a lighter background color, such as for table #5. The "active table" is the table for which all the components display data, and the indicator 116 may identify this table easily for the player, allowing the player to change active tables with a singe click.

Figure 6:
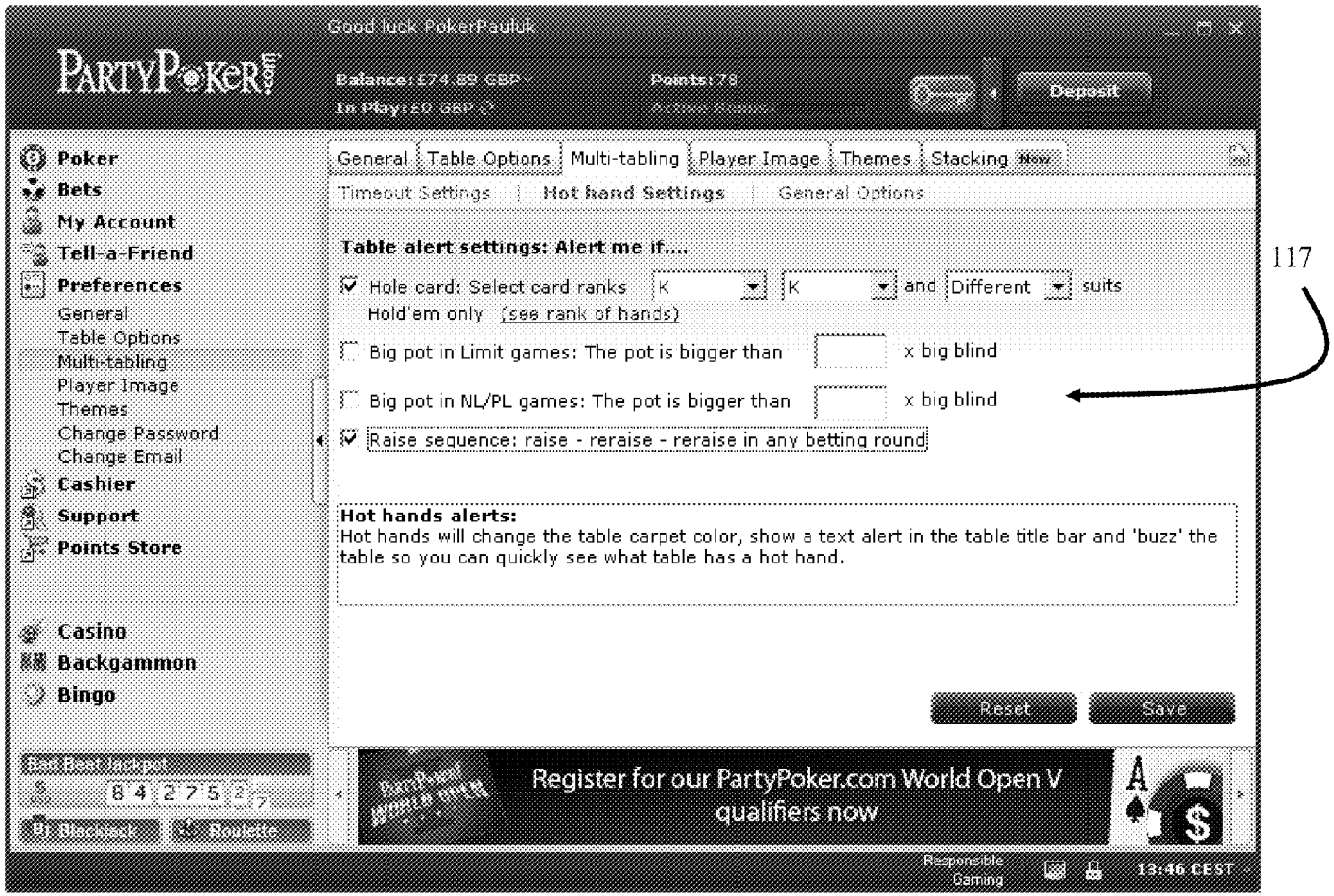
FIG. 6 is a screenshot displaying various possible hot hand preferences.

Hot Hand Alert 118:

"Hot hands" may be a player preference where a player has the ability to set an alert 118 for a given range of Hole cards selected by the player. As seen in FIG. 6, the player may select various parameters 117 to trigger a hot hand alert. For example, the player may select a certain minimum hole card threshold, e.g., a pair of 10s or a pair of consecutive suited cards. If this threshold is reached or exceeded, e.g., the player is dealt a pair of queens, a hot hand alert 118 may be displayed on the stacking system 10. In another embodiment, the hot hand alert may be triggered by the betting occurring on a table and/or on a desired pot threshold.

Figure 7:
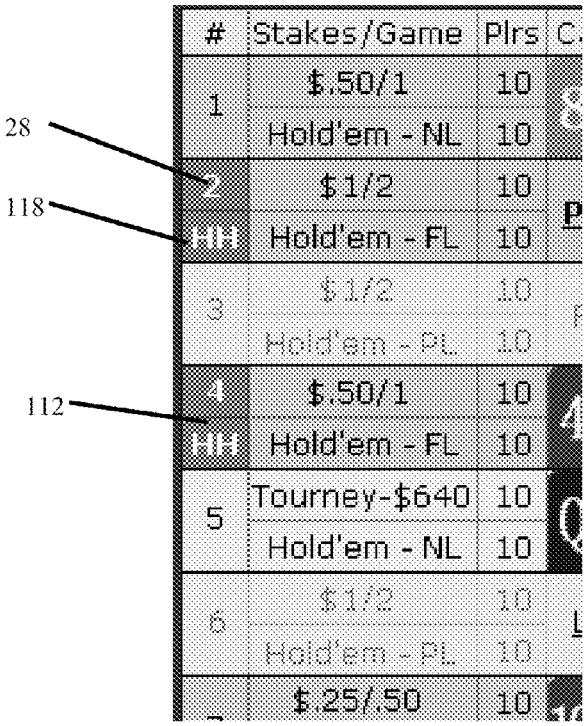
FIG. 7 is a screenshot of a portion of a table list sub-component displaying hot hand indicators.

The system may include an indicator 118 to alert the player to one or more "hot hands" on which the player may wish to focus. As seen in FIG. 7, the indicator 118 may comprise dividing the table number row 112 and adding an "HH" symbol below the table number 28 corresponding to the hot hand. In non-English versions, the HH symbol may be modified to correspond to one or more multilingual equivalents. In addition to including the HH symbol, the indicator 118 may comprise changing the background and text colors of the table number cells.

Alternatively, a hot hand alert 118 may not include an HH indicator but instead may rely on changing the background and text colors, as well as the font style of the text, and/or of the hot hand table number cells. Another option may be to reorder the rows 112 to move tables 20 corresponding to hot hands upward toward the top of the table listing. Still another indicator 118 may include displaying the text "Hot Hand" or something similar when the player moves the mouse or other cursor over the HH alert.

The HH indicator 118 may disappear once the player is not participating in the hand.

Position Column Explanation:

Returning to FIG. 2, the position column may display multiple pieces of information. This information may be displayed at all times except when the player is not playing in the hand, at which point the cell may be empty. A top section of each cell may display the player's position 46 relative to the last player to act and the number of players still in the hand 44. In addition, a bottom section may display the player's beginning position 48 at the start of the hand.

Player Position related to last player to act 46: This is the position of the player related to the last player to act in the street. In one example, the hand is Hold'em and the status is Pre-flop. The player is D+2, which means 2 positions to the right of the dealer. (Alternatively, the player preferences may be set to represent this position as D−2). There are 10 players in the hand. This will show "5/10" in the top section. In another example, 4 players fold pre-flop, including the Dealer. The hand continues and the flop is dealt. D+1 is still in the hand and is therefore the last to act post-flop. Therefore, D+2 is second last to act of the 6 remaining players. Player position is 2 of 6 players which is shows as "2/6". Continuing this example, player 5 and player 1 (D+1) of the six players fold, the notation will change to "1/4," notifying the player that he has the best position (last to act) and there are 4 players remaining This field 46 will change dynamically and immediately as things happen on the table. There preferably is no time lag, as this is critical decision making information as to which table 20 the player should to pay attention.

Players still in the hand explanation:

Each game that is played on each table may have a predetermined maximum number of seats. In one embodiment, this may be about 10 seats, although this number may change depending on the type of game and variant. As players fold, leave the table or sit out the hand, these players will not be included in the hand and the number will reduce accordingly. If the player is not in the hand, the system may include a preference setting allowing the player to hide the number of players still in the hand 44. If selected, the system will show this field 44 as empty when the player folds or is only watching the table.

Beginning position at the start of the hand is the player's position as it was at the start of the hand in Hold'em and Omaha. The 'position' pre-flop never changes during the course of the hand and remains constant for that hand, no matter what happens.

In Hold'em and Omaha embodiments, the following notations may be used to describe both pre- and post-flop positions. As mentioned above, the player preferences may be modified to represent positions to the right of the dealer as "D-n," where n is the number of seats to the right.

Pre-flop—Order to act

| Positional Notation | Long Name | Position |
|---|---|---|
| BB | Big Blind | Last to act pre-flop |
| SB | Small Blind | Penultimate to act pre-flop |
| D | Dealer | The Third last to act pre-flop |
| D + 1 | Dealer Plus 1 | One to the right of the Dealer |
| D + 2 | Dealer Plus 2 | Two positions to the right of the Dealer |
| D + n | Dealer Plus n seats | N number of seats to the right of the Dealer |

Post-flop—Order to act

| Positional Notation | Long Name | Position |
|---|---|---|
| D | Dealer | The Last to act post-flop |
| D + 1 | Dealer Plus 1 | Penultimate to act post-flop |
| D + 2 | Dealer Plus 2 | Two positions to the right of the Dealer |
| D + n | Dealer Plus n seats | N number of seats to the right of the Dealer |
| BB | Big Blind | Second to act pre-flop |
| SB | Small Blind | First to act pre-flop |

If no one is playing, or a hand or game has not yet started, there will be no number and the top section of this field may be empty. Both sections may be empty when not used to indicate if a player needs to post a blind.

In 7-Card Stud, the cards that are dealt determine the first player, and consequently, the last player to act. This positional notation as described in this requirement will not be used in 7 Card Stud. In Stud, the top section of the field may be centered horizontally in the row, and there may be no bottom section.

Time column explanation:

Like the position column, cells in the time column 119 may be divided into top and bottom sections in order to display more information to the player. The top section may include a Pre-action Indicator, e.g., "PA," a Waitlist Indicator, e.g., "WL", and a Timebank Indicator, e.g., "TB." For the Pre-action Indicator, when there is a pre-action available, an indicator may be shown in the top section and nothing may be shown in the bottom. Alternatively, the Waitlist Indicator may identify the player's position on the waitlist relative to the number of people on the waitlist.

The Waitlist Indicator may appear before there is a timer 50, e.g., when the player is waiting to be seated at the table 20. When the player has opened a waitlist table 23, the top section 126 may show the number of players waiting in the waitlist, and the bottom section 124 may show the Waitlist Indicator until the player joins the table or there is no waitlist. When the player joins the waitlist, the position on the waitlist and the number of players waiting may be contained in the top section 126. For example, "2/6" means the player is the second person in line out of six total people waiting. In addition, while waiting, the text of the rest of that table's corresponding row 112 may be grayed out or may display some other indication that the player is not sitting at the table 20. When a seat at the table becomes available, the player has the option to join the table 20, at which point a timer 50 counting down a predetermined amount of time for the player to join may appear in the bottom section 124, although the top section 126 may still contain the indicator.

The bottom section 124 may include a timer 50, which may alternate between an Action Timer 130, a Post Blind Timer 132, and a Timebank Timer 134, depending on the status of the hand.

For each given table a player may have the ability to access additional time, e.g., if the player has money invested in the pot, i.e., the player has "pot equity." When the proper requirements are met, the player may activate the timer 134 by pressing a button. In another embodiment, the timer 134 may be activated automatically once the requirements are met. Once activated the Time bank timer 134 is displayed.

When the timer 50 enters the Timebank 134, the bottom section 124 of the Time column may have an indicator for the Timebank. The timer 50 will change and show the Timebank timer 134.

Action Timer 130: In order to distinguish one table's timer from another potential table's timer, each action timer color may be as per its respective table 20, as may be the font color.

Post Blind/Ante Timer 132: As seen in FIG. 5, this timer 132 may appear when the player is playing a game that includes a timer in the client and when it is the player's turn to post a blind.

Table Seats Information Column 136 explanation:

This column also may be divided into two sections. As seen in FIG. 2, there may be a top section 138 for seated players 142 and a bottom section 140 for total seats available 144.

Seated Players: seated players 142 are those players that are actually seated at the table whether they are sitting out or not. This may only be updated at the beginning of the hand and not in between or could be distracting. If there is too much change to this field, it could be excessively distracting. In addition, a reserved seat will be regarded as a seated player. If there is a waitlist, the seat will be 'seated' until the table actually has a free seat.

[Total] Seats Available: this is the total seats 144 at the table. Depending on table type, this may be 2, 6, 8, 9 or 10, or may be some other predetermined number.

Figure 3:
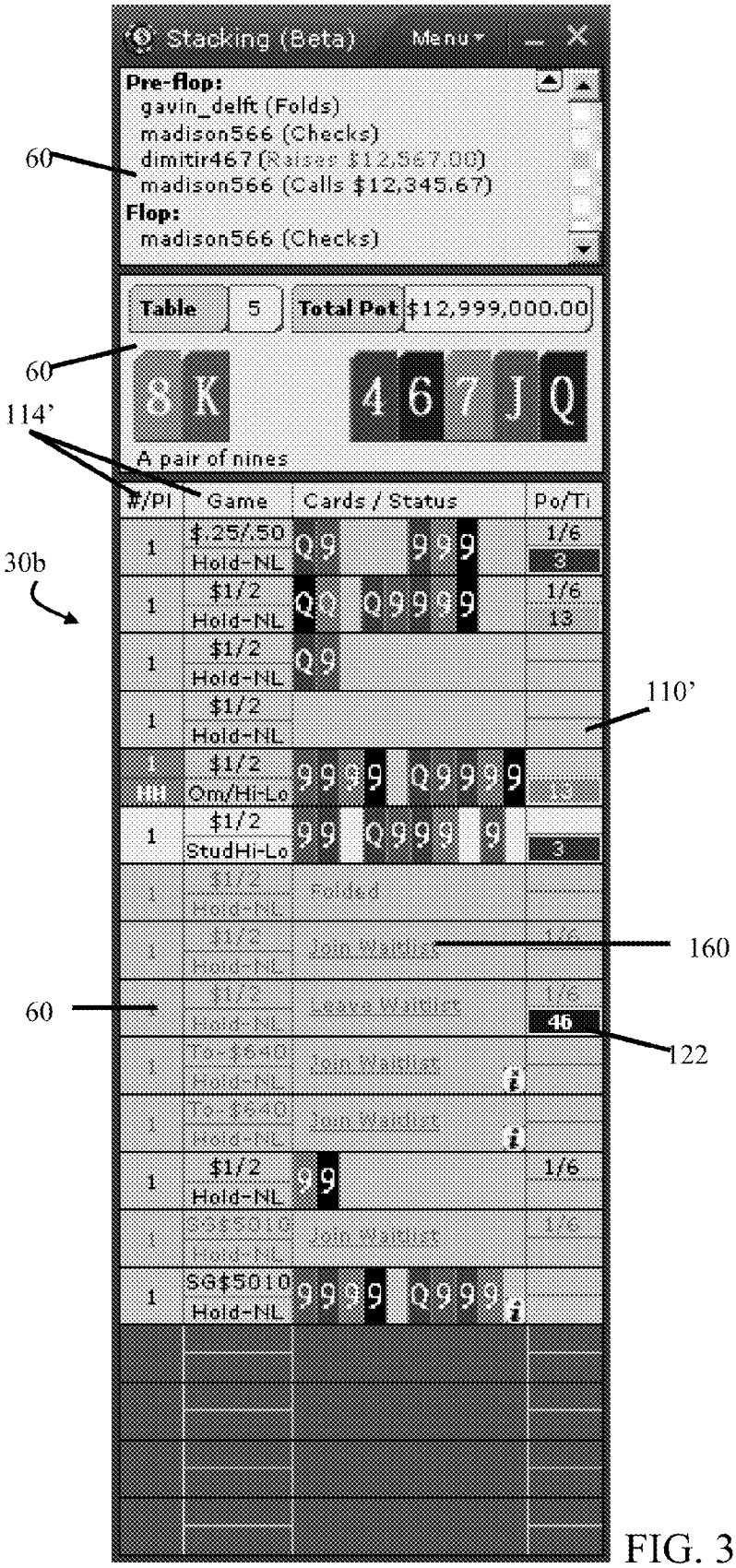
FIG. 3 is a screenshot of an exemplary small stacking component.

Stakes/Game Column 146 (Stakes/Blinds/Antes & Game Type) explanation:

As seen in FIGS. 2 and 3, there may be two sections to this field. A top, or first, section 148 may display the table's stakes 36, blinds, antes and/or buy-in values. A bottom, or second, section 150 may display the Game Type 32 (e.g. Hold'em) and variant (e.g. NL, Hi-Lo etc). If the space does not allow for the full game type and variant, shortened names or abbreviations may be used. If the table 20 is part of a tournament, this column 146 may display a "Tour" short name and the buy-in amount, e.g., "Tour-$640."

Sorting and Grouping:

In one embodiment, tables, i.e., rows 112 in the table list sub-component 110 initially may be sorted based on the Table Number column, with Table 1 being at the top and all numbers below in ascending order.

Tables 20 may be sortable according to the Table Number and/or game/stakes columns, although other sorting functions may be possible. For the first option, the player may sort the tables according to ascending or descending table number. For the second option, games may be sorted in the following order: cash games, single-table tournaments, other tournaments, and play money games. The game type then may be added to the mix of ordering, e.g., in the following order: No Limit Hold'em, Pot Limit Hold'em, Fixed Limit Hold'em, Pot Limit Omaha, and 7-Card Stud. From there, tables then may be ordered by the Stake Level with the highest Stakes first (0.25/0.50 before 0.10/0.25). In one embodiment, if the games are a mix of Hi-Lo, the Hi will go first and the Hi-Lo will go after. Moreover when clicked in descending order, an inverse of the above sorting may take place.

Figure 8:
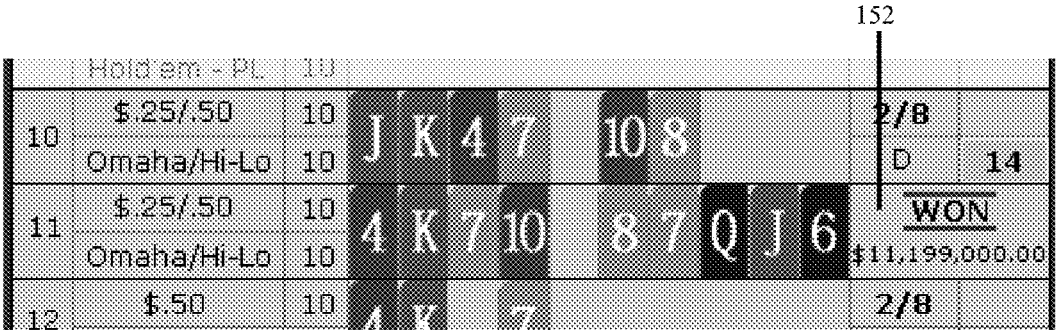
FIG. 8 is a screenshot of a portion of a table list sub-component displaying a winning hand indicator.

Show Winning/Losing Hands: the system may include an indicator 152 to alert the player to winning and/or losing hands at each of the tables being played. In one embodiment, both the position and time columns for a given table may be replaced in their entirety with this indicator 152. As seen in FIG. 8, this indicator 152 may include text noting the win, along with the amount won.

Figure 9:
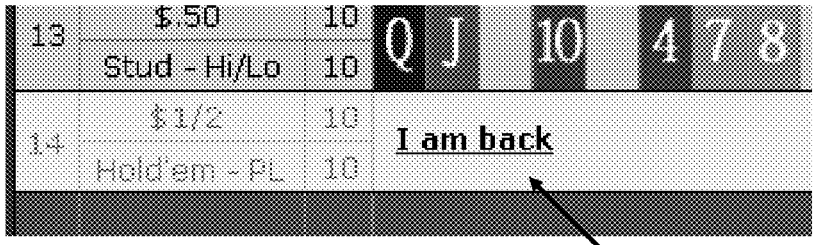
FIG. 9 is a screenshot of a portion of a table list sub-component notifying the player of one or more tables at which the player is sitting out.

Away from/return to a table option 154:

A player may be allowed to sit out a hand from a table. When, sitting out, the row corresponding to that table may change colors to indicate an inactive status, and a link to return to the table may be displayed. See, e.g., FIG. 9.

Figure 10:
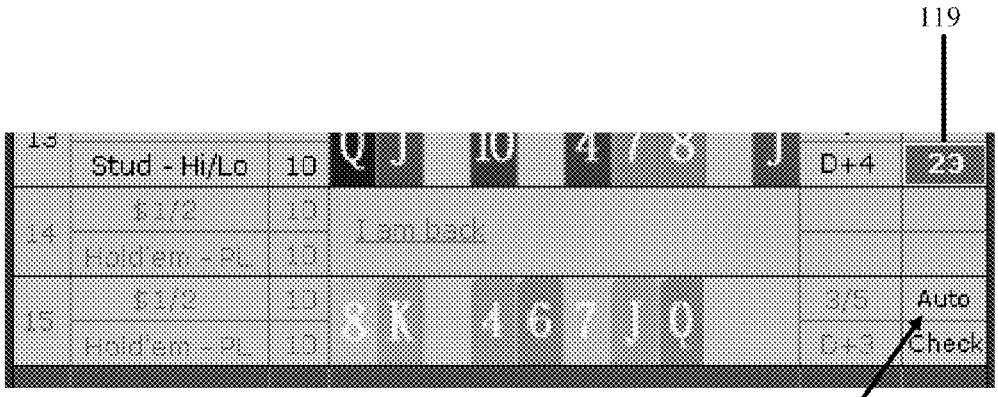
FIG. 10 is a screenshot of a portion of a table list sub-component used with a large stacking component allowing the player to auto-check for one or more tables.

Auto Check 156 activated: Similarly, if the player opts to auto-check hands on a table, the row representing that table may change in appearance to signify that it is not an active table. In addition, the time column 119 may display an indicator such as "Auto Check" to alert the player to the status of the table. See, e.g., FIG. 10.

Figure 11:
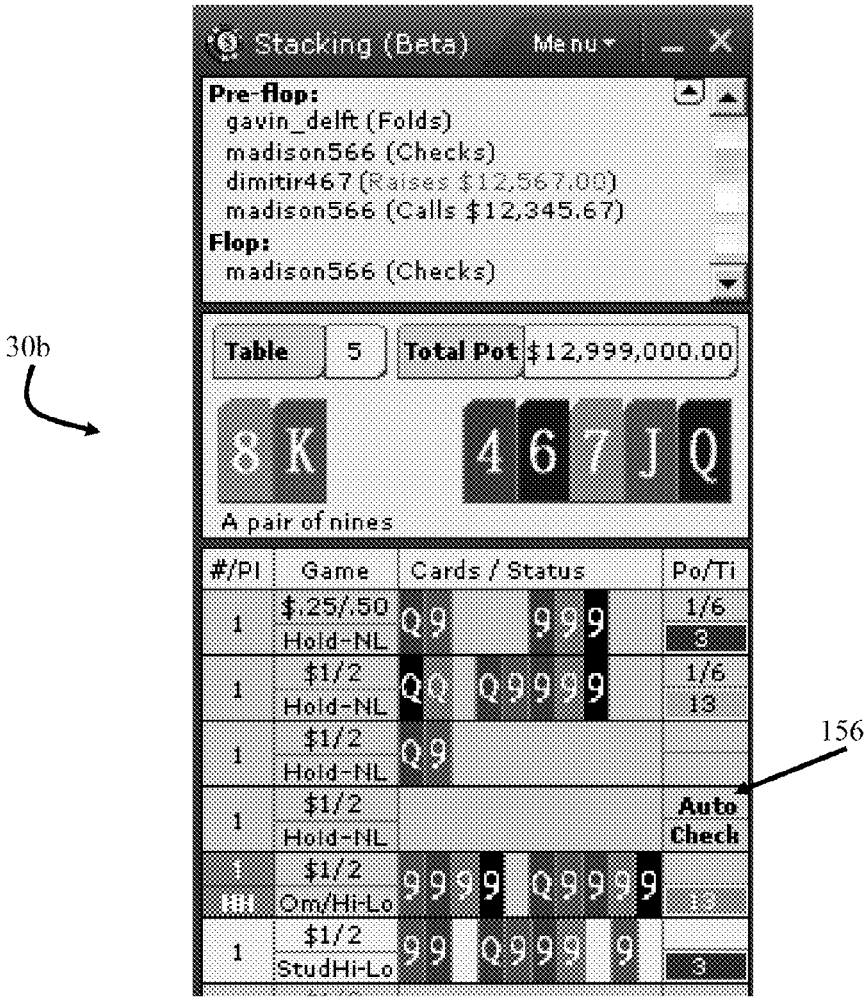
FIG. 11 is a screenshot of a portion of a table list sub-component used with a small stacking component allowing the player to auto-check for one or more tables.

In another embodiment, corresponding to a smaller stacking component 30*b*, described below, the auto-check indicator 156 may appear as shown in FIG. 11.

Waitlist Functionality:

When the player opens a table that is full or waitlisted, the player will have the option to join the waitlist 158. In the table stacking component 30, the Join Waitlist text may be displayed in the Status column to indicate a hyperlink 160 which selection will result in adding the player to the waitlist.

The number of players currently in the waitlist 158 may be in the top section 126 of the Time column 119. When the player is on the waitlist 158, the top section 126 of the Time column 119 may have the position of the player in the waitlist first, a backslash (/) and the number of players in the waitlist, e.g., 8/13 means 8th position in a waitlist of 13 players. A waitlist timer 122 may appear when the count reaches 0 and the player is able to join the table.

Figure 12:
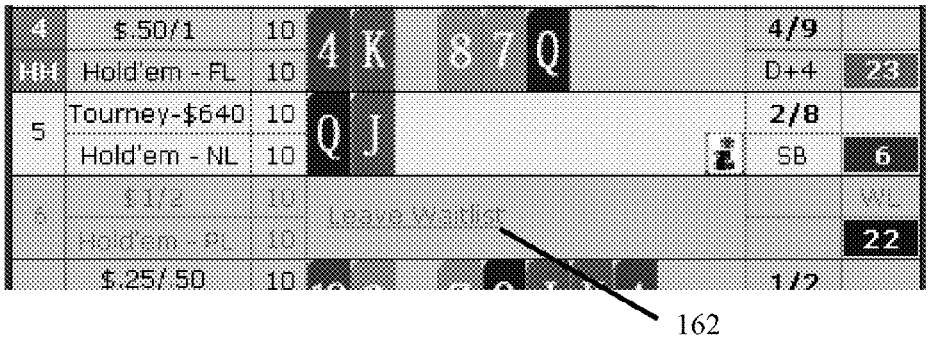
FIG. 12 is a screenshot of a portion of a table list sub-component displaying waitlist information and options for a table.

Once a player has joined a waitlist 158, a Leave waitlist link 162 may be displayed, as seen in FIG. 12. Once clicked, the player will be removed from the waitlist 158, but the table may remain open and viewable by the player.

Figure 13:
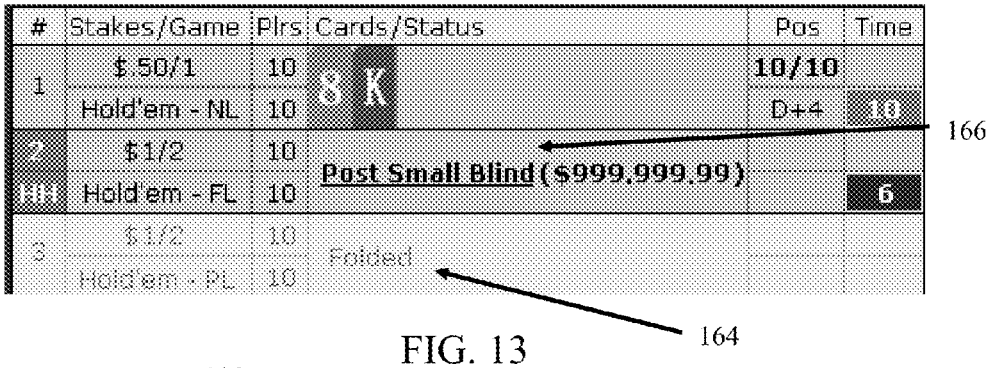
FIG. 13 is a screenshot of a portion of a table list sub-component indicating a folded hand at a table.

Folded Hands: Folded hands may have all columns 114 emptied except for the table number, status and the players and Stakes/Game columns. All text may be grayed out if displayed, and the status cell may display a text indicator 164 indicating that the hand was folded. See, e.g., FIG. 13.

Post Blinds: If a player has the option to post small, big or dead blinds, the status cell may indicate as much, along with a description of the type and amount of the blind. This indicator 166 also may serve as a link to allow the player to post the blind directly.

Tournament Icon/Lobby Link: When the table is a tournament able, an icon for information may appear at the bottom-left of the "Cards/Status" column. Selecting this link may open and display the related Tournament Lobby to the player. In addition, tournament hands that are being watched may have the text "Watching—Tournament ID/Table number" displayed in the Cards/Status Column, while the colors of the row 112 may indicate that the table is inactive.

Inactive hands: A hand is regarded as inactive when, e.g.: it is folded, there is a showdown and the player loses, the player is watching tournament tables, the player is sitting out, the player is waitlisted, the tournament is pause mode or taking a break, or the table is waiting for players to join (e.g. heads-up tables or a table where all other players are sitting out).

Unused Rows 113: The table stacking system may include more rows than open tables. In one embodiment, the system may collapse this sub-component 110 to include only as many rows 112 as open tables. In another embodiment, the system 10 may include unused rows 113 at the end of its list as place-holders for additional tables.

Figure 14:
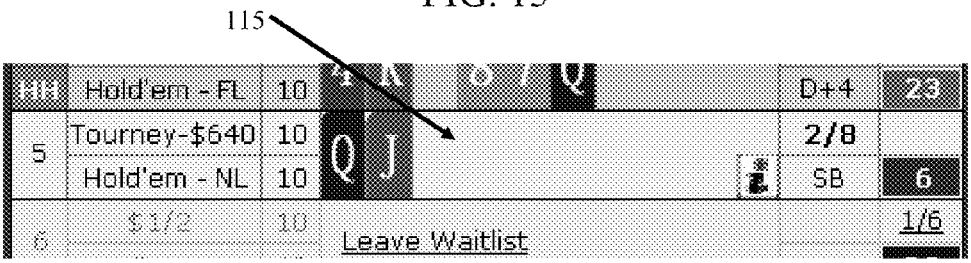
FIG. 14 is a screenshot of a portion of a table list sub-component indicating an selected table or row.

Selected Row 115: This is the row that is 'selected' at any one point in time and is linked to the action top sections. As seen in FIG. 14, the selected row 115 may be displayed differently, e.g., having a different background shading color, so as to make it more readily identifiable to the player.

Session Persistence: All columns 114 preferably maintain the player-chosen settings across sessions (session persistence). This means that all list component preferences preferably are saved as soon as the player chooses the settings. As such, any crashes or system disconnects preferably will not affect the player's settings.

Multi-lingual: Preferably each of these system sub-components include text translated into the language chosen by the user. In the event that translations do not fit in the space provided by the stacking system 10, selecting or mousing-over the text may reveal the translated text.

Figure 15:
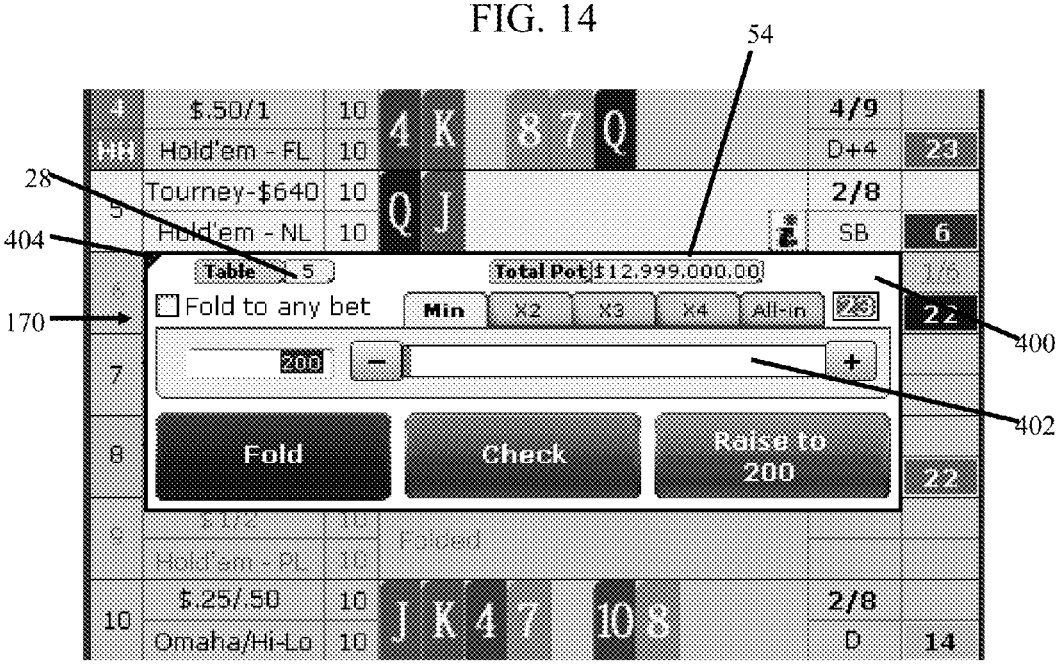
FIG. 15 is a screenshot of an alternate action area sub-component overlaid on a table list sub-component.

Alternate display, e.g., right-click option: If the Action Area component (discussed below) is hidden based on the player preferences, an alternate display option 170, such as a right-click or some other access method, may be available. As seen in FIG. 15, one embodiment of this alternate action area display 170 is provided, where the action area component 400 is displayed proximate the row corresponding to the selected table. In this embodiment, the table number 28 and the total pot value 54 may appear above the slider area 402. Action, pre-action and post blinds options may be shown upon right click. If none are active, then the right click may show nothing. Alternatively, if the right-click option is disabled, the stacking system 10 may display action area component 400.

Figure 35:
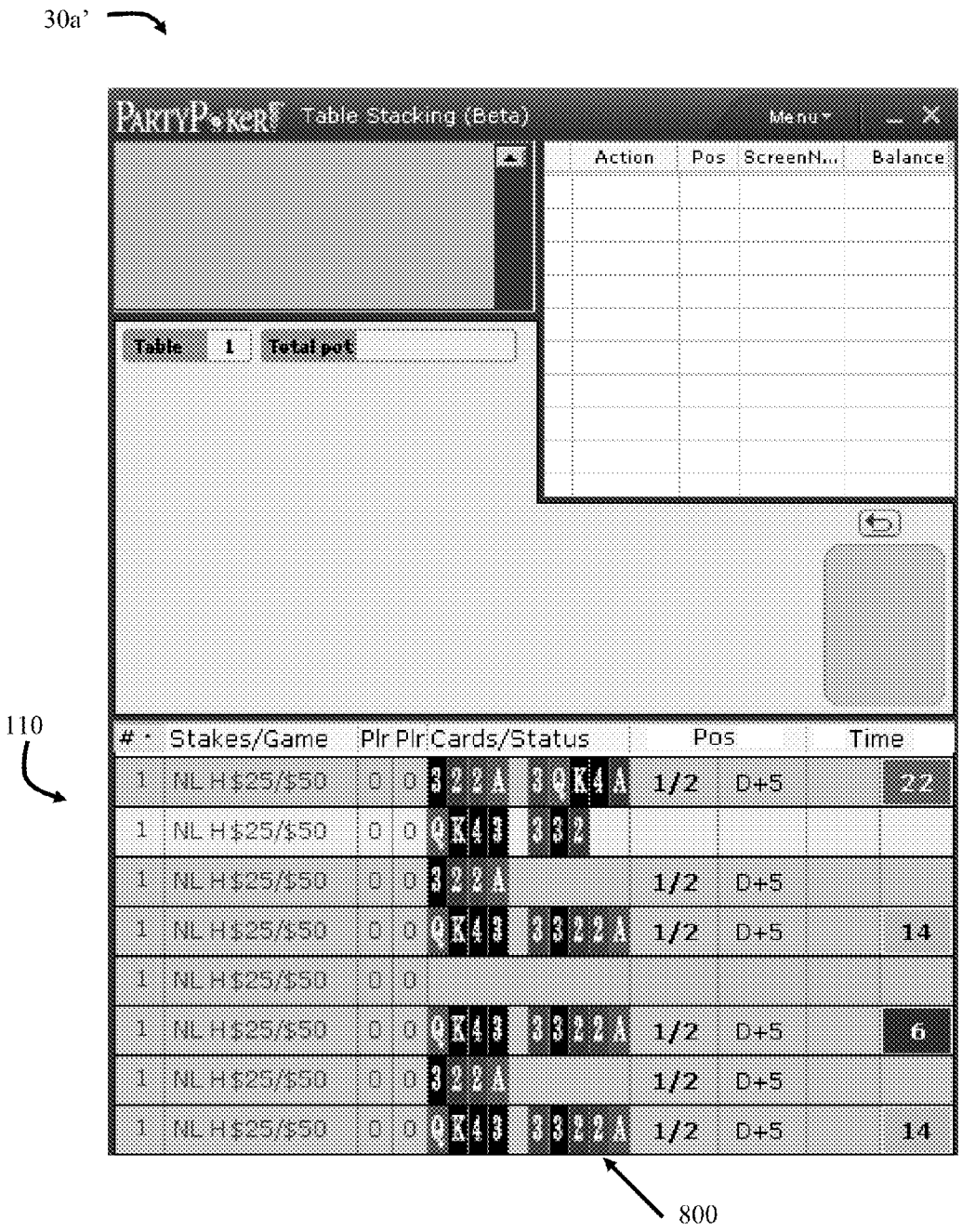
FIG. 35 is a screenshot of yet another exemplary large stacking component layout, including tables utilizing smaller decks.

Small deck in List Component:

In one embodiment, the system 10 may allow the user to set a preference for the size of the deck 800 used with the table list component 110. For example, and as seen in FIG. 35, the user may be able to select that a smaller deck be displayed for each table. Similarly, the user may be able to select a table layout having smaller row heights, which selection may prompt the system 10 to display the smaller decks in each row. Here, any text not fitting in the area designated may have the full text revealed in a tooltip upon mouse over. Additionally, the functionality of the table list component 110 may be the same as that of a larger card row/column arrangement.

Figure 16:
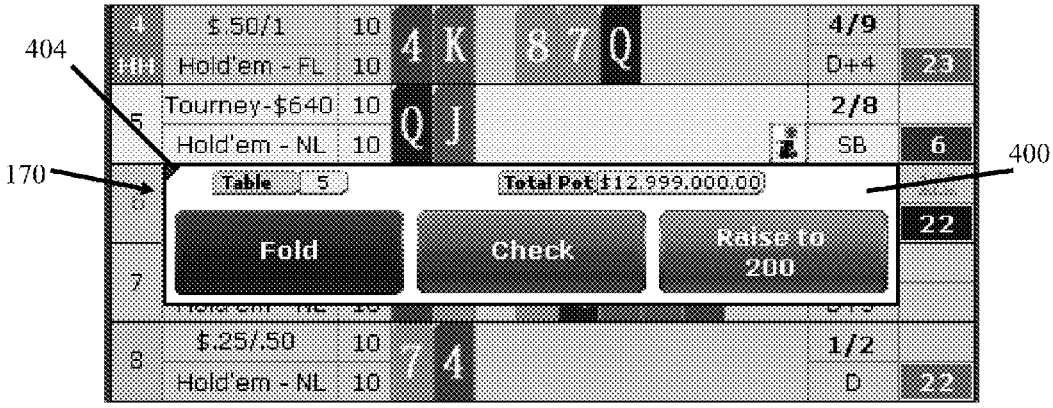
FIG. 16 is a screenshot of another alternate action area sub-component overlaid on a table list sub-component.

In another embodiment, if the selected table is a limit game, the area may not include a slider area and may be significantly smaller, as seen in FIG. 16.

In either case, the pop-up action area may include an indicator 404 pointing to the table to which the action area 400 relates.

Player Information (Info) Component: This sub-component 200 is a presentation of the key information related to a hand in a list format rather than trying to find the same information on the table 20. This sub-component 200 shows the player information of players at the table, their table balance, position in the hand and any previous actions.

Players may use third party tools to analyze their play or the play of their opponents, and this is seen as an extra addition to the information that players may use to make decisions, thereby aiding them to make quicker decisions and providing them with timely and pertinent information required to make better decisions. It is also a clear visual presentation of those players that are still in a hand at any point and also shows the action occurring on the previous street. As such, this sub-component 200 preferably is included in any table stacking system 10 display.

The basic idea of the player information component 200 is to show only the players that are still in the hand and display the information required for a player to make an intuitive decision, based on the information at hand, in a timely and easily processed manner.

Figure 17:
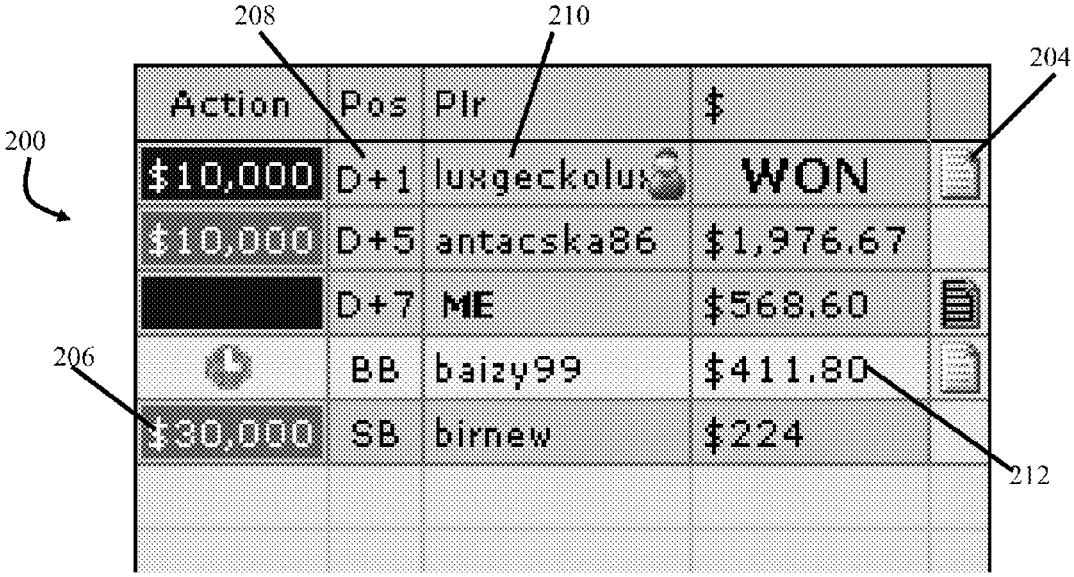
FIG. 17 is a screenshot of an exemplary player information sub-component.

One example of the player info component 200 may be seen in FIG. 17.

The player who will act last in a street preferably is displayed at the top, the second last in the position second from the top, etc. This means that it will be easy to spot the player who has the best position in the hand and the player who has the worst by just glancing at the Player Info component 200.

As players fold, they may disappear from the player info component 200.

If the preference is set to show folded players, the next available position below the active players may contain the details of the folded player. Example: Player 1, 2 and 3 in that order. Player 3 raises. Player 2 folds. Player 2 will be folded and go to position 3 and player 3 will take position 2 in the grid 202.

Sitting Out Players: Preferably, players not participating in the hand will not be seen in the Player Info component window 200 as they have no bearing on the outcome of the hand. These players preferably also will not be included in any way in the hand history or the previous actions of the hand.

All data shown will be real time and be updated as actions happen on the table. If the hand is not yet in progress, no information may be displayed in the player info box 200. Only when the server sends the information on the new hand and the players in the hand will this component 200 show the player information.

The player information sub-component 200 may include the following information about each player at a given table: a player action icon 204, previous/action 206, position 208, screenname 210, and balance 212. The player action icon 204, upon mouse over or other form of selection, may display the opponent notes if the player has made notes about this player. The icon may take on one appearance if the selected player has folded and a different appearance if the selected player remains in the hand.

Figure 18:
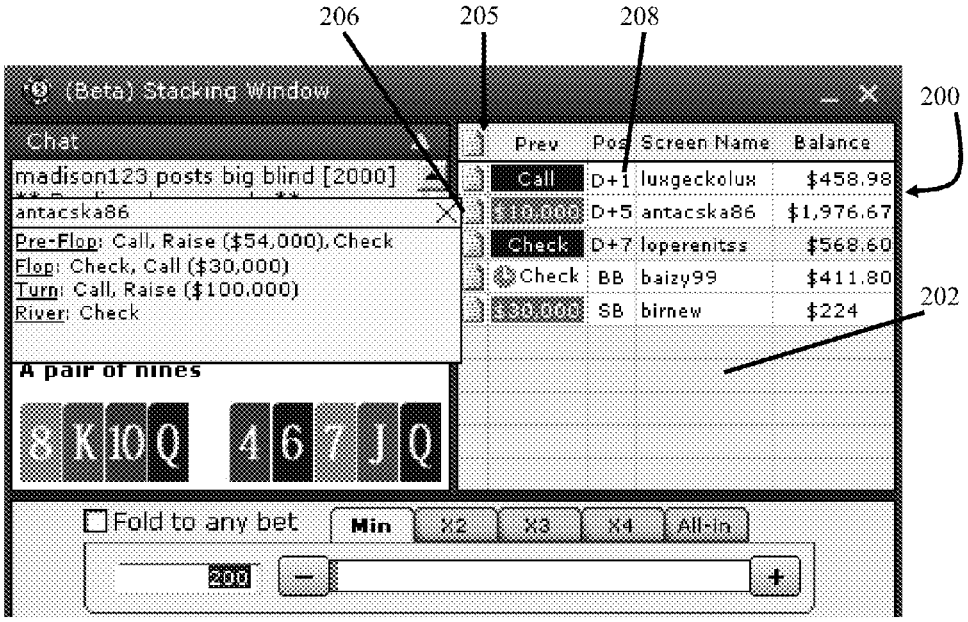
FIG. 18 is a screenshot of a player information sub-component displaying the last actions during a hand for a selected player.

The player action column 205 may, when selected or upon mouse-over, contain and display the last actions of the each player, as seen in FIG. 18. Preferably, this section 205 is updated if the player whose history is being examined acts while the history is being viewed.

If the player clicks (or upon mouse over) on the header section over the Previous actions icon 206, only the actions of that player may be displayed. This display may disappear as soon as the mouse moves outside the area, or the display may include a closing icon such as an "X" in the top right so that it can be closed explicitly.

The Previous/Action column may display all the actions related to the street, switching from the "Prey" text to "Action" depending on the status of the hand. If the player is acting and made a previous action during this street, the previous action may be persistent until the next street. However, if that player currently is acting, the cell may be empty except for a clock icon indicating that it is the player's turn to act. When the street is completed, the actions in this column may be cleared.

The Pos Column (Position) may show the positional notation 208 as per the stacking component 30*a*.

Pre-flop—Hold'em & Omaha: The top position of BB preferably may be at the top. The SB will be next and the Dealer will be next and D+1 (Dealer plus one to the right) will be next etc.

Post-Flop—Hold'em & Omaha: The top position of D preferably may be at the top once still in the hand. The D+1, D+2 etc. (Dealer plus one to the right) will be next etc. The penultimate position preferably will be BB, with SB last if that player is still in the hand post-flop.

The screen name column may be simply the screen name 210 of any players in the hand (or folded if these also are displayed). If the name doesn't fit within the column, the player can hover over the name and the full name may appear.

Figure 19:
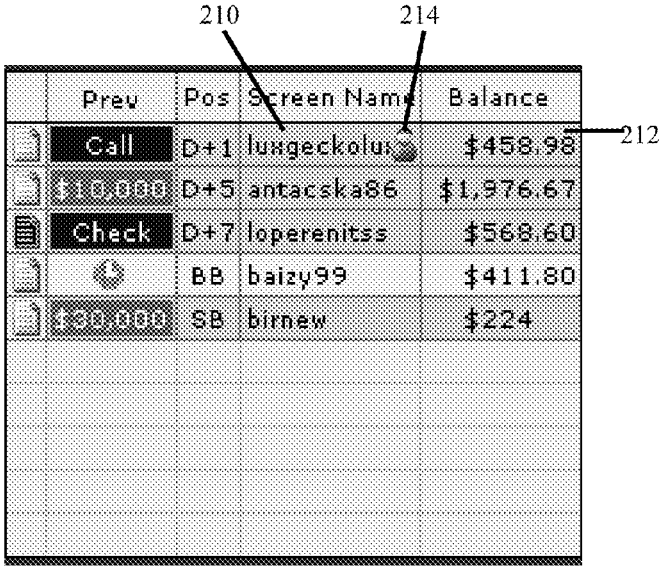
FIG. 19 is a screenshot of an exemplary player information sub-component including a buddy icon or indicator for one or more other players at a table.

Buddy Information: In one embodiment, the player may be able to right click on the player info over an opponent's name anywhere in the row and choose to add that player as a "buddy." The opponent will be added to the player's buddy list, and a buddy indicator 214 will be added the right of the screenname row, as seen in FIG. 19.

The balance column may display the actual player balance 212 at any point in time and preferably will be a real time update as per what happens on the table 20. If a player goes All-in, the text "All-in" may appear in the table balance until the end of the hand.

Figure 20:
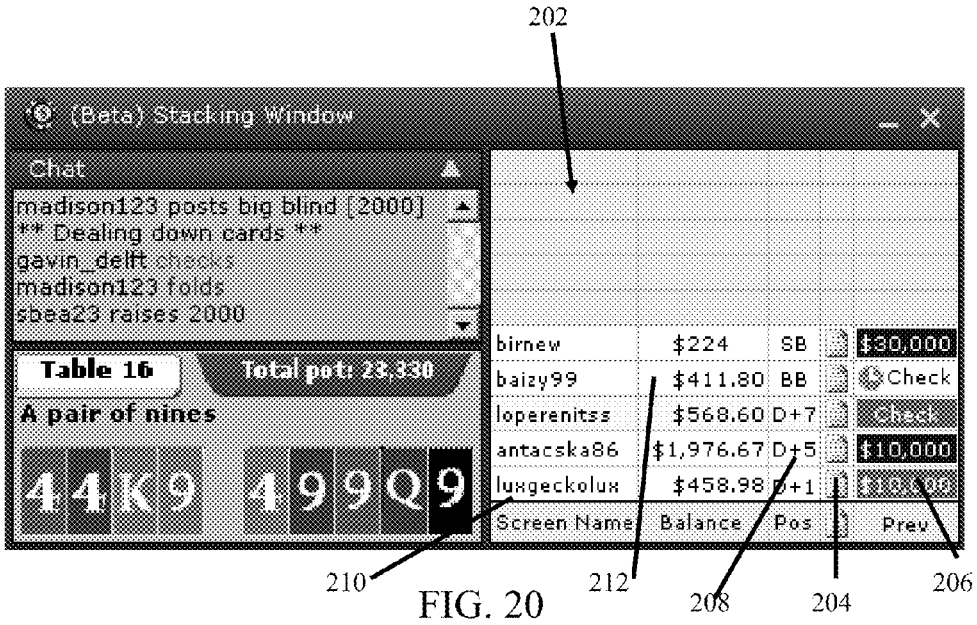
FIG. 20 is a screenshot of another exemplary player information subcomponent.

If desired, it is possible that the player info component grid 202 may be reversed or otherwise rearranged based on a player preference. As seen in the alternative embodiment of FIG. 20, the same columns may appear in this option, although the order of columns may be modified at the player's option.

Hand Information Component: This sub-component 300 shows the dealer chat 302 related to the chosen table in the stacking list component 30*a*.

Figure 21:
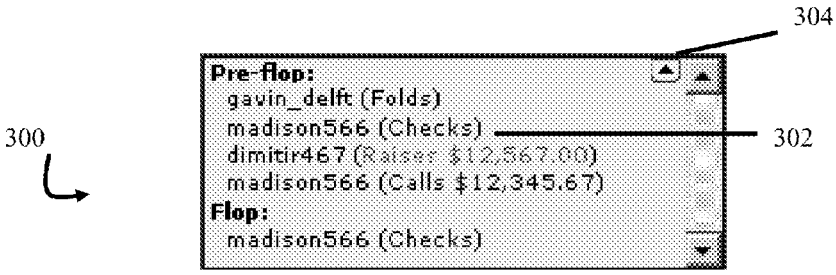
FIG. 21 is a screenshot of an exemplary hand information sub-component.
Figure 22:
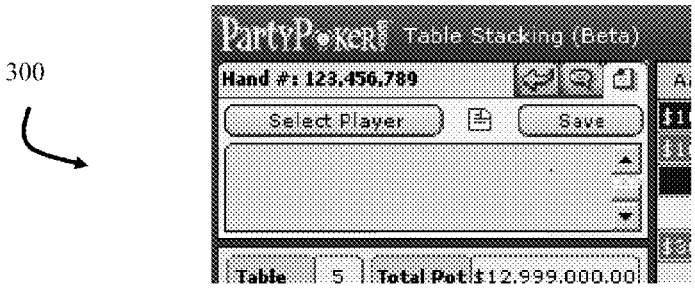
FIG. 22 is a screenshot of another exemplary hand information sub-component.

The purpose of the Dealer Chat 302 is to display all the actions of all players who have participated in the hand. To be regarded as having participated in the hand, a player must have been dealt cards. One example of the hand information component 300 can be seen in FIG. 21. A second example may be seen in FIG. 22. In this example, the sub-component may include an identifier of the hand being played, such as a display of the hand number.

The hand information component 300 may allow the player to manually input information about one or more of the other players in the hand. When a player wants to enter their player notes, the system may allow the player to minimize or otherwise hide the hand information area, which may display a "select player" option. Choosing this option then may allow the player to input specific notes about the hand and/or a selected player. This component also may allow the player to display information on a previous hand, e.g., by selecting a previous hand icon.

Actions may be separated and correlated per street for clarity's sake, and different actions such as checks vs. raises may be displayed differently to provide easier visual recognition to the player. Similarly, the street names may be on a separate line and each action may have its own line.

It is not mandatory to show this sub-component 300, although it preferably may be displayed when the console 21 is displayed. The chat 302 can be hidden or minimized, e.g., by selecting a minimize icon 304, even when the sub-component 300 is displayed.

Action Area Component: This sub-component 400 shows the action or pre-action buttons related to the chosen table in the stacking list component.

Figure 23:
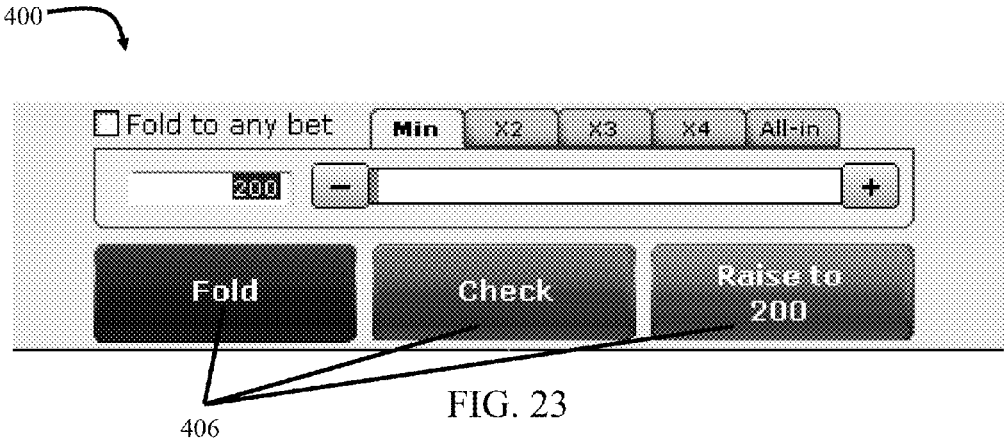
FIG. 23 is a screenshot of an exemplary action area sub-component.

One example of the action area component 400 can be seen in FIG. 23.

The action area may include Action Buttons 406 such as "fold," "check," and "raise to _____." In addition, pre-action assets 408 preferably also may be displayed, as will any other button options. Other button options that may appear in the client (such as Waitlist, Post Blind, etc.) preferably also appear in the action area 400. In one embodiment, other options such as "Wait for big blind" and "Fold to any bet" may appear if they are displayed on the table.

Figure 24:
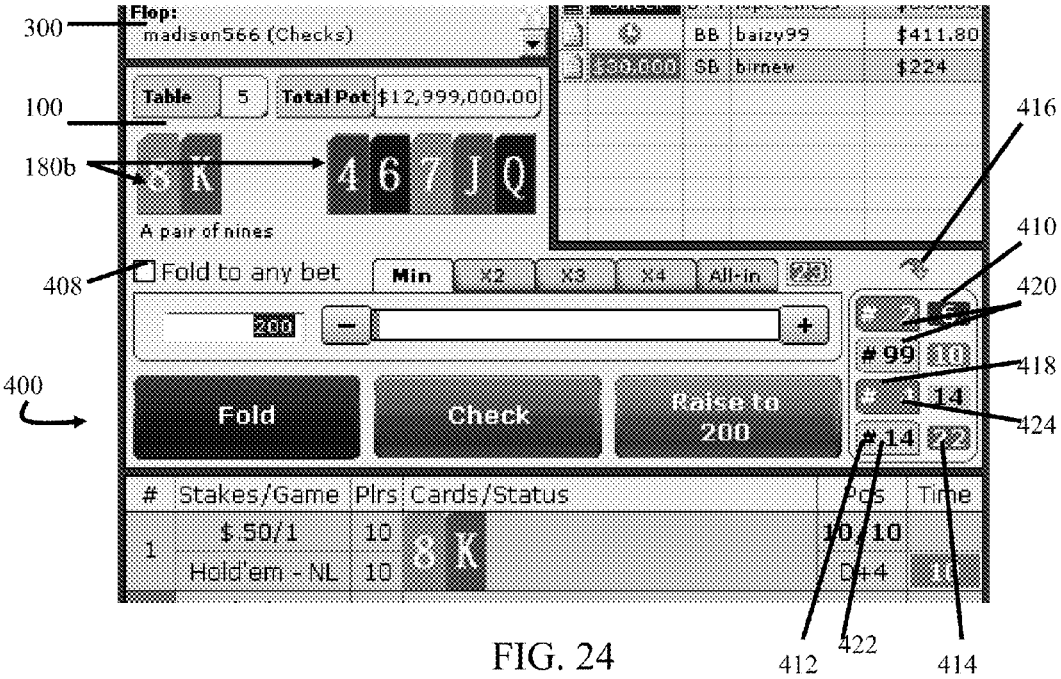
FIG. 24 is a screenshot showing an action area sub-component with several other sub-components.

It may not be mandatory to show this sub-component 400. However, the action area 400 preferably may appear with the console area 21 and the hand information area 300 when these sub-components are displayed, as seen in FIG. 24.

Table Timer: The action area 400 may include a table timer 410 to display the time remaining to act for several of the tables being played. As seen in FIG. 24, the table timer 410 may include a column of table numbers 412 with a corresponding column 414 displaying the time in seconds remaining to act for those tables. The time values may have different backgrounds depending on the amount of time left to act, e.g., changing from green to yellow to orange to red as the remaining time diminishes. In addition, the table timer 410 may display those table numbers for urgent tables, i.e., those for which action is most imminent, and it may display the tables in order of increasing time to act.

The table timer 410 preferably only displays those tables 20 that have a timer requiring action. This includes any timer (action, waitlist, post blind etc). If two tables happen to have the same timer in seconds, either one may be placed first in the list, although the tables preferably are ordered by table number. Additionally, whatever hand is displayed in the console area 21 preferably does not also appear in the Urgent Table/Table Timer area 410.

Previous table icon 416: When a player clicks on the previous table icon 416, the details for the action, player info and hand information of that previous table preferably are displayed.

Hot Hand alert 418: The action area may include an alert notifying the player that he or she currently has a table open at which the player has a hot hand. This alert 418 may include, e.g., altering the background color of the action 400 and/or console 21 areas.

In another embodiment, the Urgent Table and Hot Hand alerts may be combined so that the player may be notified of not just those hands that require action but also of which of those hands are hot hands. As seen in FIG. 24, this dual notification 420 may include a first background 422 for standard urgent tables and a second background 424 for hot hand urgent tables.

Timebank in Action Area: When a table is in focus in the action area 400 and that table 20 is using the timebank, the stacking system 10 may include a timebank indicator 426 or "TB" to notify the player of that fact. See, e.g., FIG. 25. Here, the game table and stacking components may act independently. For example, if the slider is used on the table, the raise button may increase on the table but neither may change in the stacking component action area. As such, the raise that is selected is the value sent to the server.

Other Features of the Stacking Component

In another embodiment, the system 10 may include a lobby tab. This tab, which may be part of the stacking component 30*a*, may display a mini-lobby to the player when selected. One advantage of this tab may be to allow players to find new games quicker and without having to go back to the main lobby.

Small Stacking Component Dialogs

In the small stacking component 30*b* set-up, several of the dialogs used in the large component arrangement 30*a* may be available. These may include, for example: Player Information, Action Area, Chat, and Console individually, or Console and Action Area together.

The columns 114' available in the small stacking window 30*b* sub-components preferably have the same functionality as that of the large stacking window 30*a* sub-components, although visual changes may be made to accommodate the smaller size of the former sub-components. For example, in the table list sub-component 110', abbreviations of the games being played may be required, and the leading zeros from the micro limit stables may need to be removed (e.g. $0.25/0.50 instead of $0.25/0.50).

Similarly, the position and time columns in the table list sub-component 110' may be combined in the small stacking window 30*b*, with the player's position in a hand relative to the number of players still in the hand being displayed above the time remaining to act in that hand.

Large Stacking Component Layouts

Figure 26:
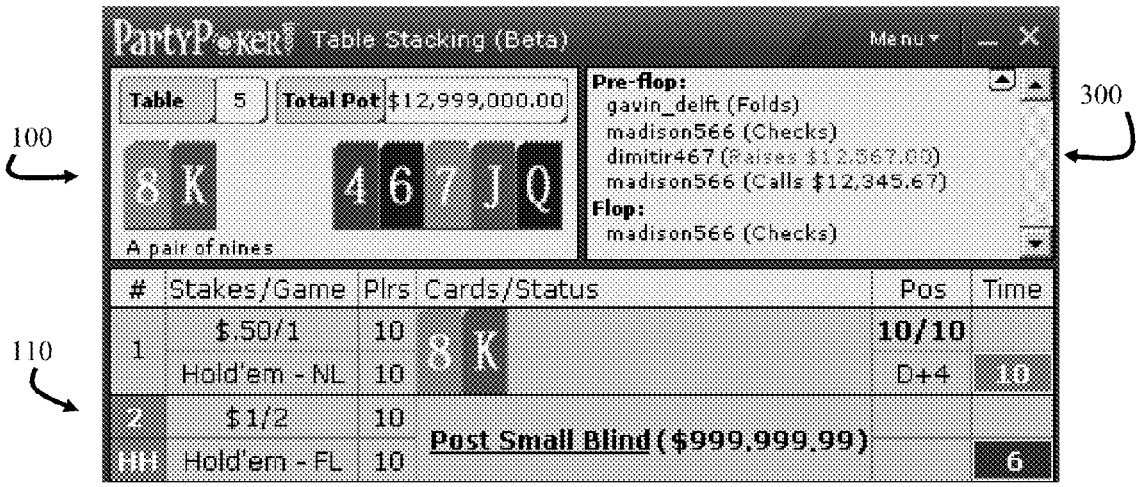
FIG. 26 is a screenshot of an exemplary large stacking component layout.

The system 10 may include various possible layouts of sub-components. For example, although other combinations are possible, the system 10 may include the following layouts:

Layout 1: Console 21 and Hand Information 300 available side by side. See, e.g., FIG. 26.

Figure 27:
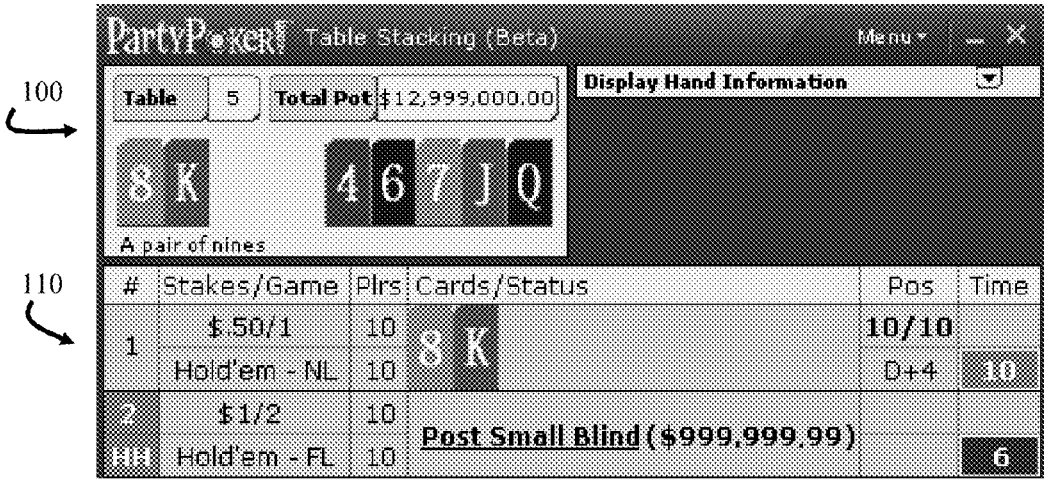
FIG. 27 is a screenshot of the layout of FIG. 26 with the hand information sub-component hidden.

Here, there may be an option to hide Hand Info 300. The Hand Information 300 can be hidden but its space, e.g., the area at the top right still may be reserved. See, e.g., FIG. 27.

Figure 28:
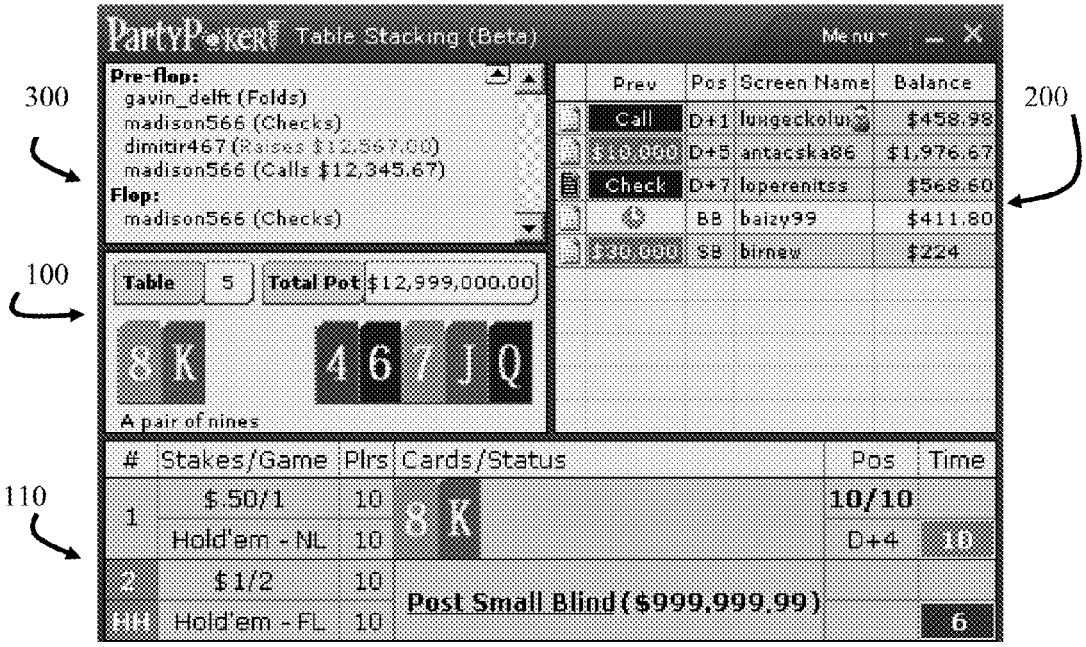
FIG. 28 is a screenshot of another exemplary large stacking component layout.

Layout 2: Console 21, Hand Information 300 & Player Information 200. In this view, the only sub-component not available may be the Action Area sub-component 400. See, e.g., FIG. 28.

Here, there also may be an option to hide Hand Info 300. Similar to FIG. 26, but the space originally displaying the hand info (here, the top right) still may be reserved.

Figure 29:
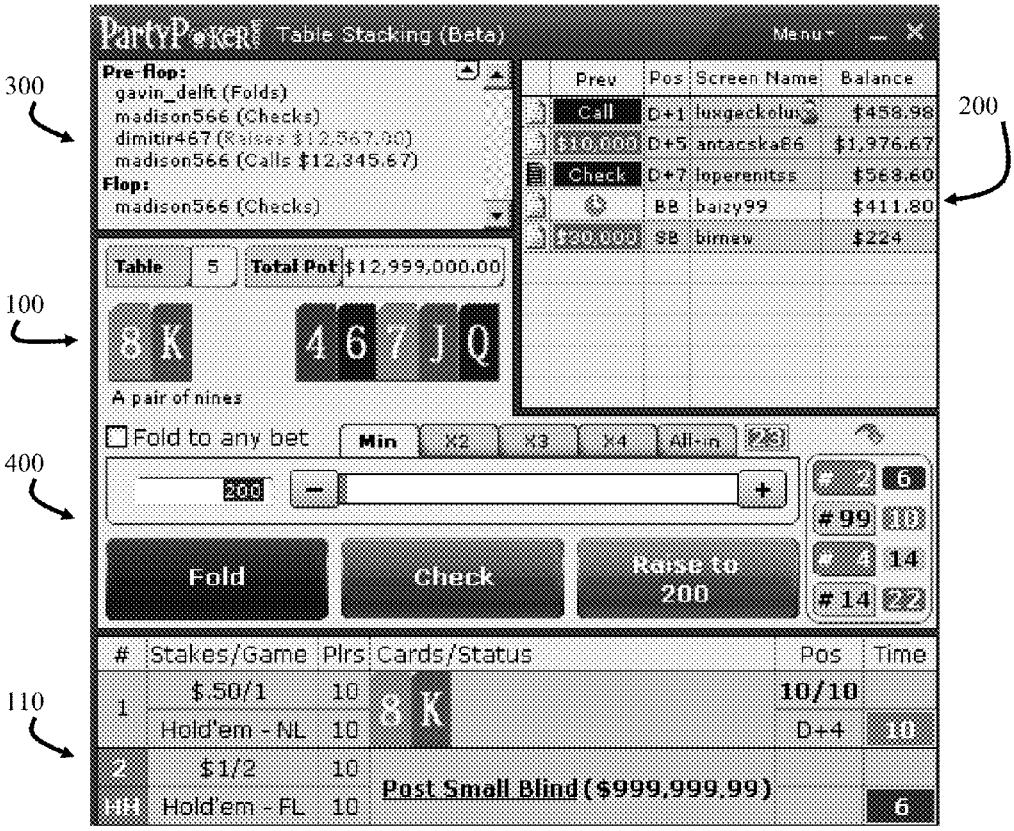
FIG. 29 is a screenshot of still another exemplary large stacking component layout.

Layout 3 (default): ALL COMPONENTS. See, e.g., FIG. 29.

Similarly, the Hand Information 300 can be hidden but the space where it generally is displayed, e.g., at the top right, still may be reserved.

Layout 4: List only. As seen in FIG. 30, this option has none of the other sub-components available.

Figure 31:
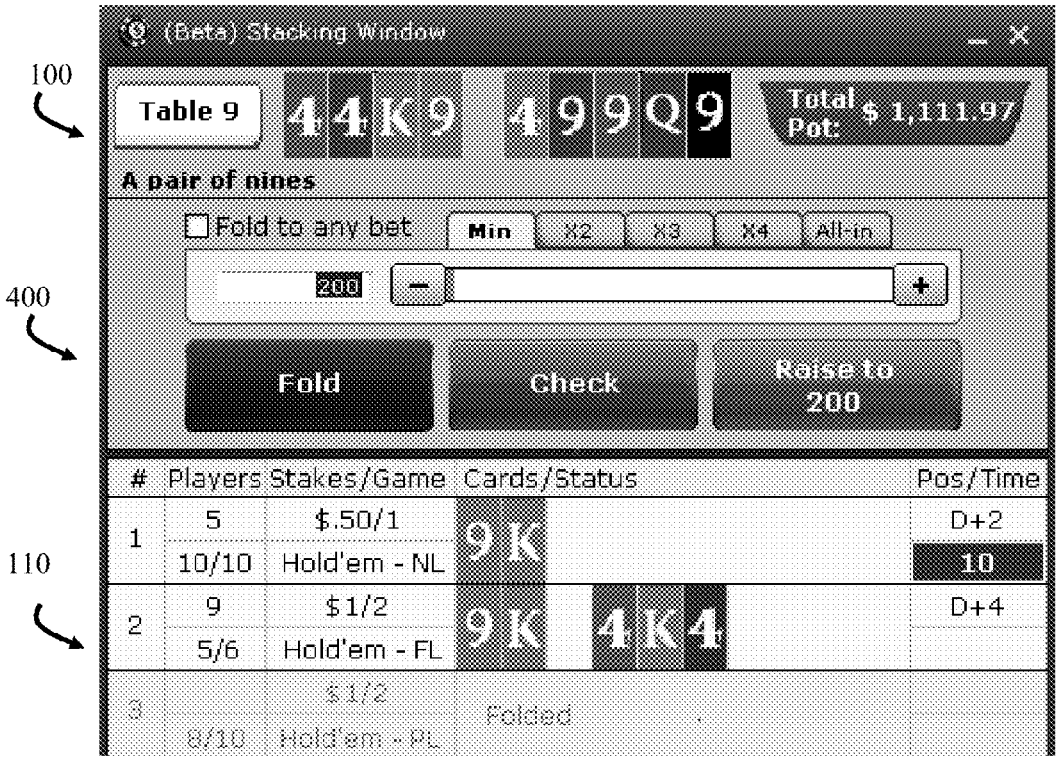
FIG. 31 is a screenshot of another exemplary large stacking component layout.

Layout 5—Action Area 400 and Console 21 integrated with no other Sub-Components. If this layout is chosen, the Player Information 200 and Hand Information 300 sub-components may appear above. See, e.g., FIG. 31.

Figure 32:
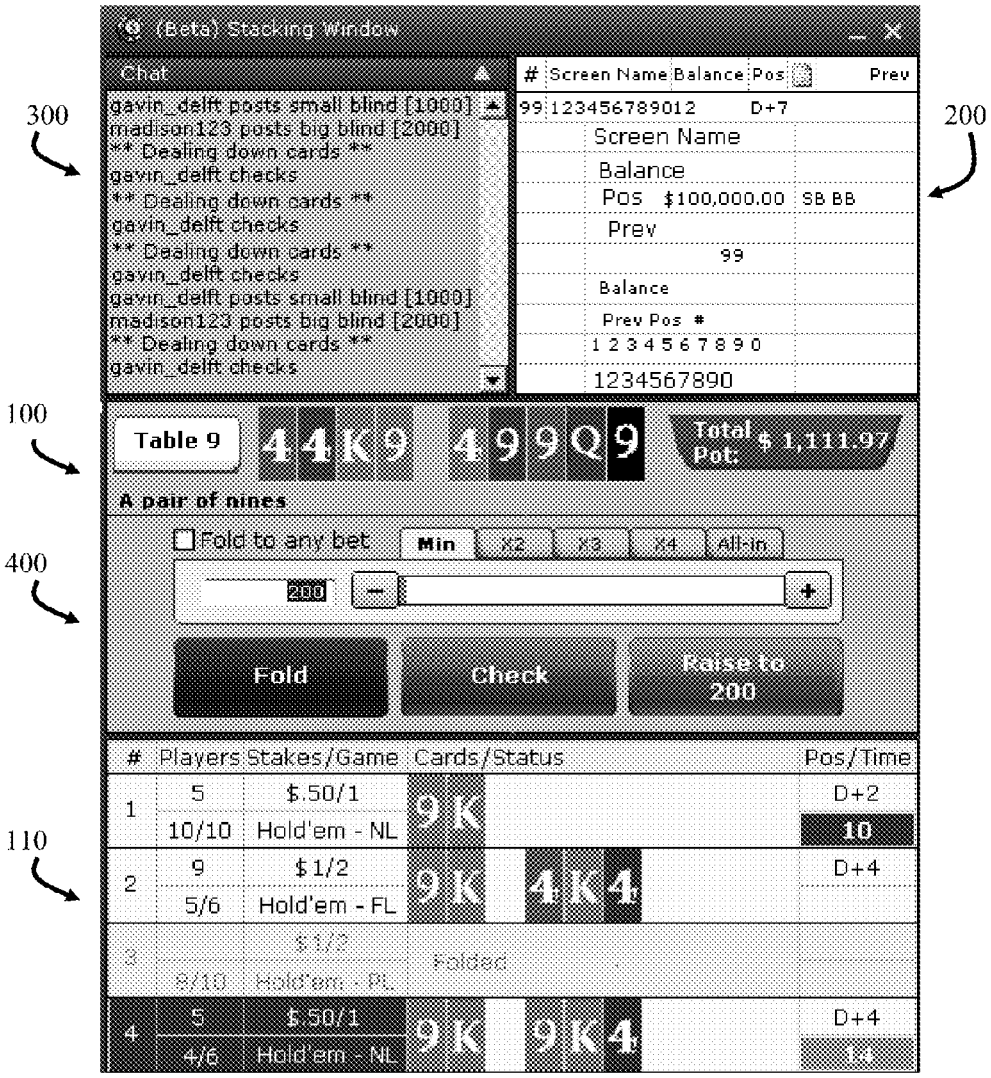
FIG. 32 is a screenshot of still another exemplary large stacking component layout.

Layout 6—Action Area 400 and Console 21 integrated with ALL Components. See, e.g., FIG. 32.

Figure 33:
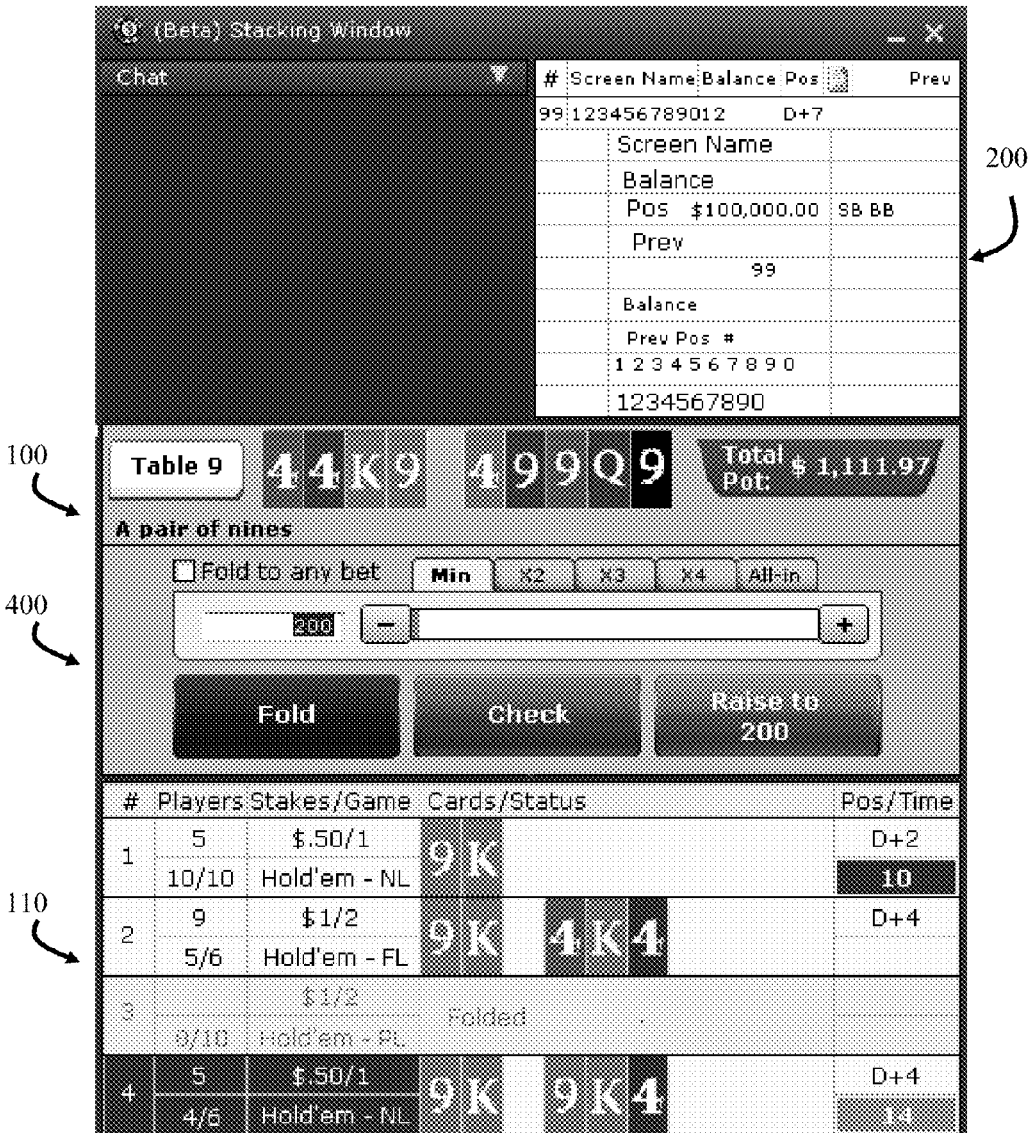
FIG. 33 is a screenshot of the layout of FIG. 32 with the hand information sub-component hidden.

Here, there may be an option to hide Hand Information 300. See, e.g., FIG. 33.

Figure 34:
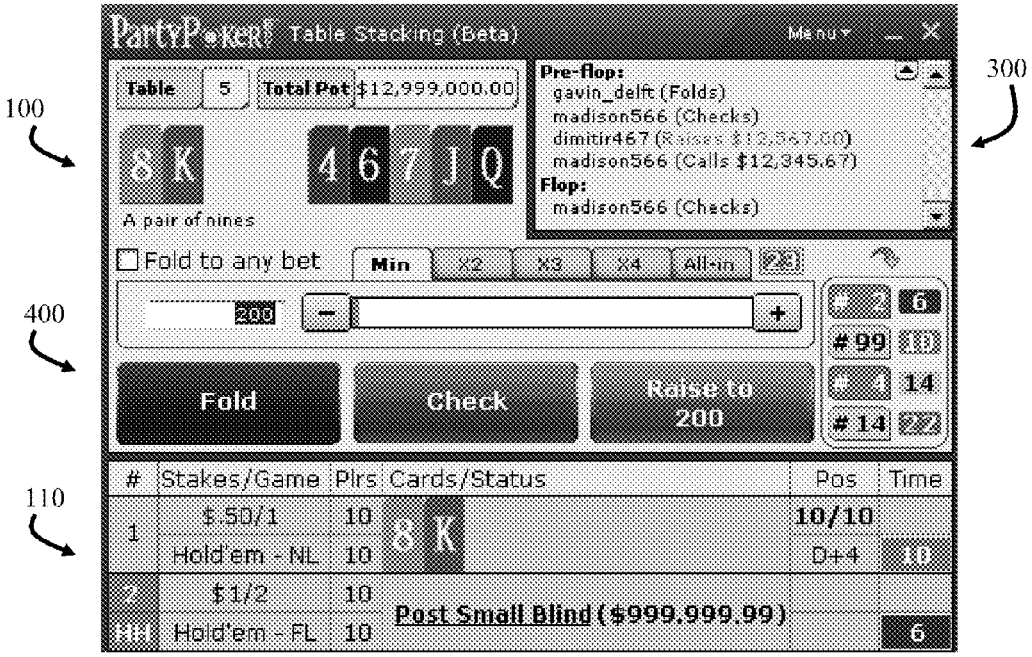
FIG. 34 is a screenshot of another exemplary large stacking component layout.

Layout 7—Action Area 400, Console 21 and Hand Information 300 available. As seen in FIG. 34, this layout may place the Action Area 400 below the Console 21 and Hand Information 300.

Layout 8—All Large Stacking size Component layouts also may have the ability to use a smaller deck and therefore a smaller row height. As seen in FIG. 35, the width of this modified large stacking component 30*a*' may be the same as for other large stacking components 30*a*. However, the decreased row heights may allow the user to obtain information from more tables at one time.

Hand Info 300 also may be hidden here.

Small Stacking Component Layouts

Figure 36:
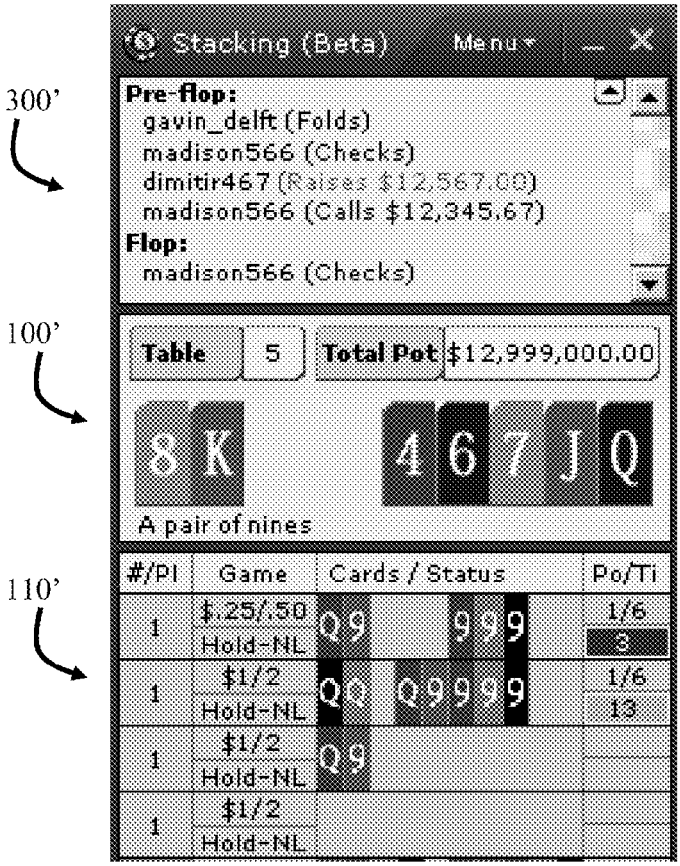
FIG. 36 is a screenshot of an exemplary small stacking component layout.

There are a number of valid and possible layouts detailed below:

Layout 1 (default): Console 21' and Hand Information 300' available one on top of the other. See, e.g., FIG. 36.

Figure 37:
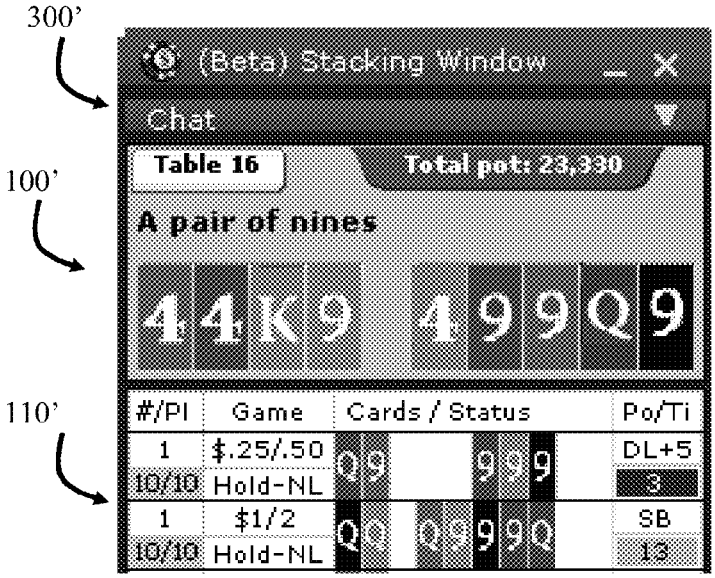
FIG. 37 is a screenshot of the layout of FIG. 36 with the hand information component hidden.

Layout 1(a): Hand Information 300; hidden option. See, e.g., FIG. 37, showing the hand information area 300' collapsed when hidden.

Figure 38:
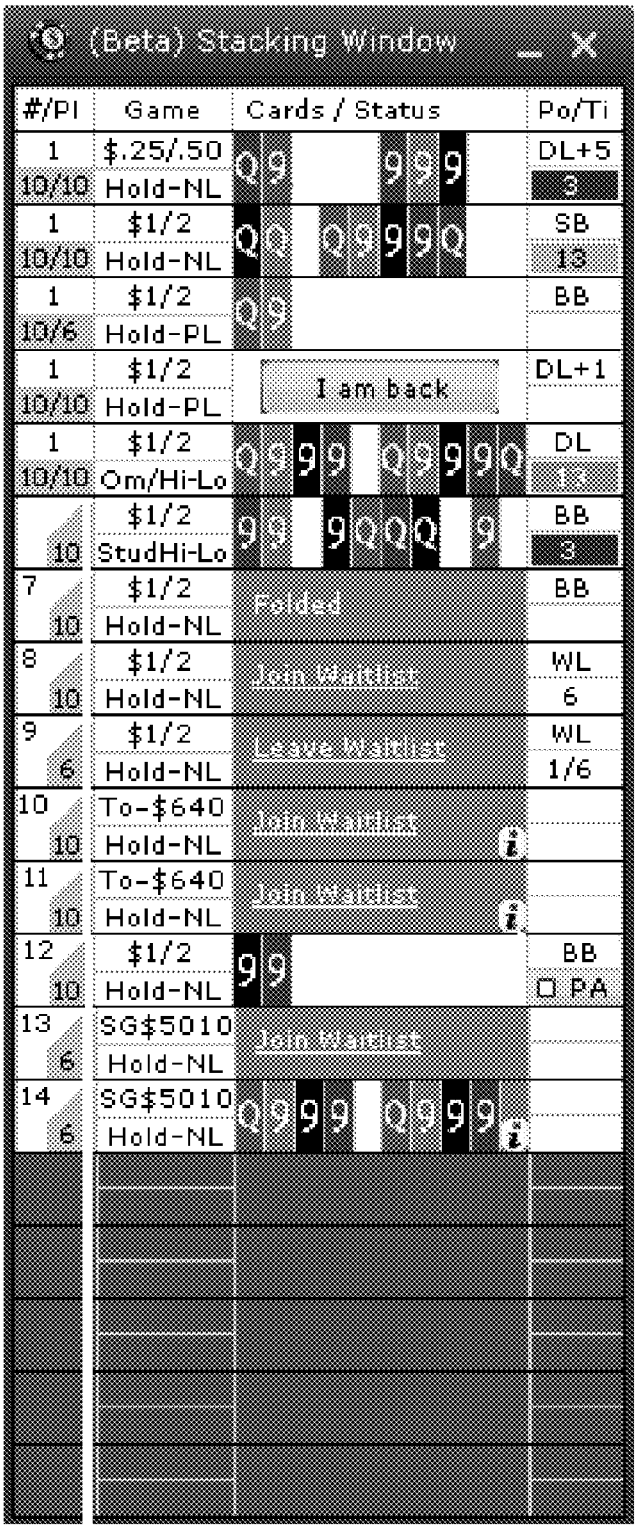
FIG. 38 is a screenshot of another exemplary small stacking component layout.

Layout 2: List View 110' only. This view means that no other sub-components will be available other than the list sub-component 110'. See, e.g., FIG. 38.

Stacking Preferences

Players may be able to set and modify their stacking preferences through a "Preferences" user interface 500 having the following tertiary navigations: General Options 510; Display Settings 600; Hand Information 700; and Deck 800.

Figure 39:
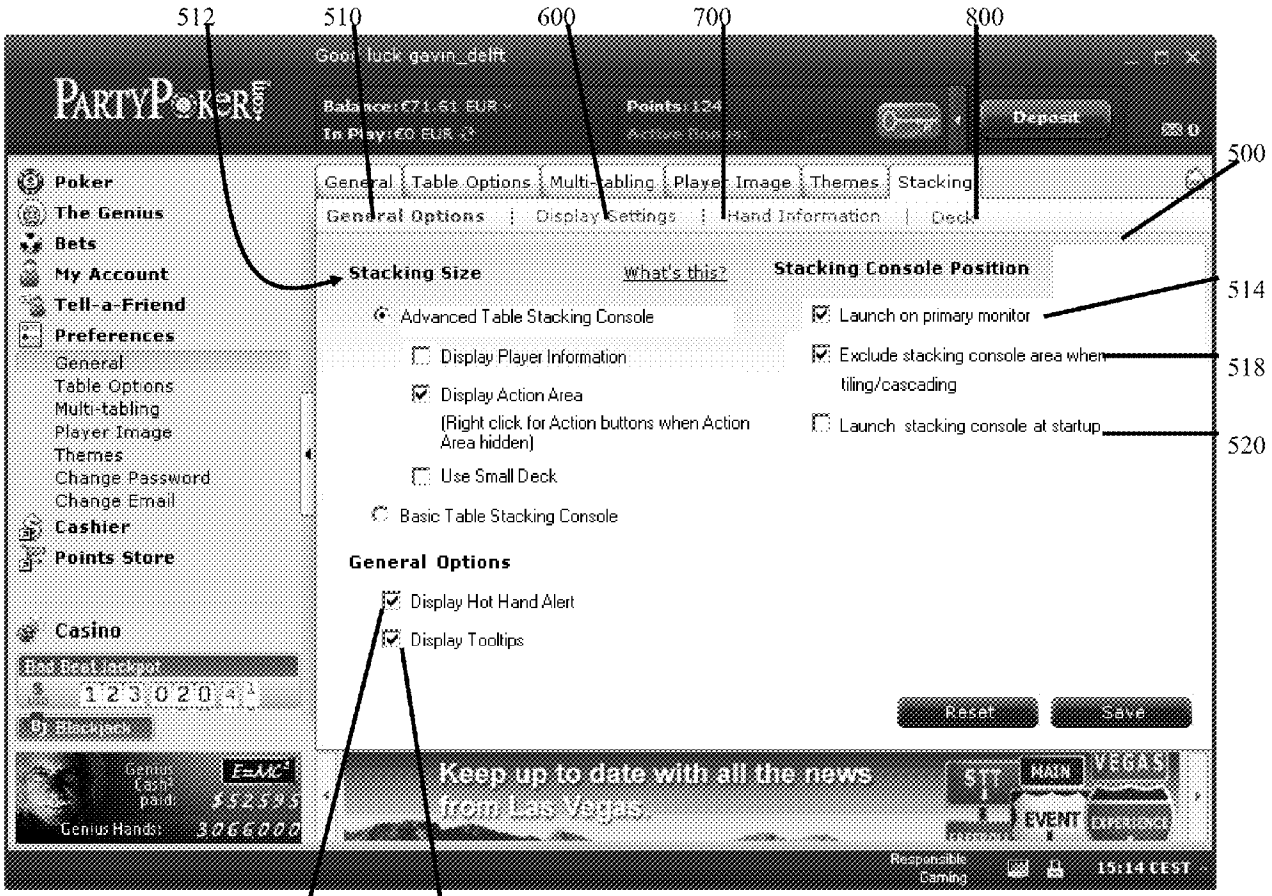
FIG. 39 is a screenshot displaying exemplary user-modifiable general options.

General Options:

Turning to FIG. 39, the stacking General Options 510 tab preferably contains the player choice of which stacking window is to be used plus some other options that are general in nature.

Large Size or Advanced Table Stacking Console versus Small Size or Basic Table option 512: This option 512 allows the player to determine the stacking component he or she wants to use. By default, the large size 30*a* may be selected. Within the large stacking console option, the player may have the option of selecting whether or not small decks should be used to display table information. When selecting the large size, the player also may have the option to select whether to display the player information dialog 200 and/or the action area dialog 400.

Changes to the layout and switching between small and large size windows preferably occur as soon as the change is made in the preferences in the Lobby. Similarly, it is preferable that players need not close all tables before switching views.

Launch on primary monitor option 514: Players may use more than one monitor for their gaming experience, or to be able to play on one monitor and perform other tasks on a second monitor 1106. If this option 514 is checked, then the stacking window will launch on the primary monitor 1104. If it is unchecked, it will launch on the second monitor 1106. If the stacking console is closed and reopened, it preferably reopens in its previous position. Any new session will respect the player preferences.

Other general options 510 may be available to the player. These options may include:

Display Hot Hand Alert 516: When selected, all aspects of the hot hand alert 118 preferably are implemented across the multiple dialogs 60 of the stacking component, namely in the: Table Number Column in the List Component, Action Area Component background, Console Component Background, Right Click Action Area component, and Urgent Tables Functionality. (When a table is displayed in the Urgent Table area, the table may have the color of a Hot Hand.)

Table stays in focus until action is complete

Exclude stacking console area when tiling/cascading 518: When selected, the stacking console area is not included on the monitor when the player opts to use tiling or cascading.

Launch stacking console at start-up 520: When selected, this simply launches the stacking console 21 when the client starts up.

Display Tooltips 522: When selected, this causes the system to display all Stacking Console tooltips. This option may be turned off, but it may provide an excellent way for the player to see the purpose for one or more components.

Figure 40:
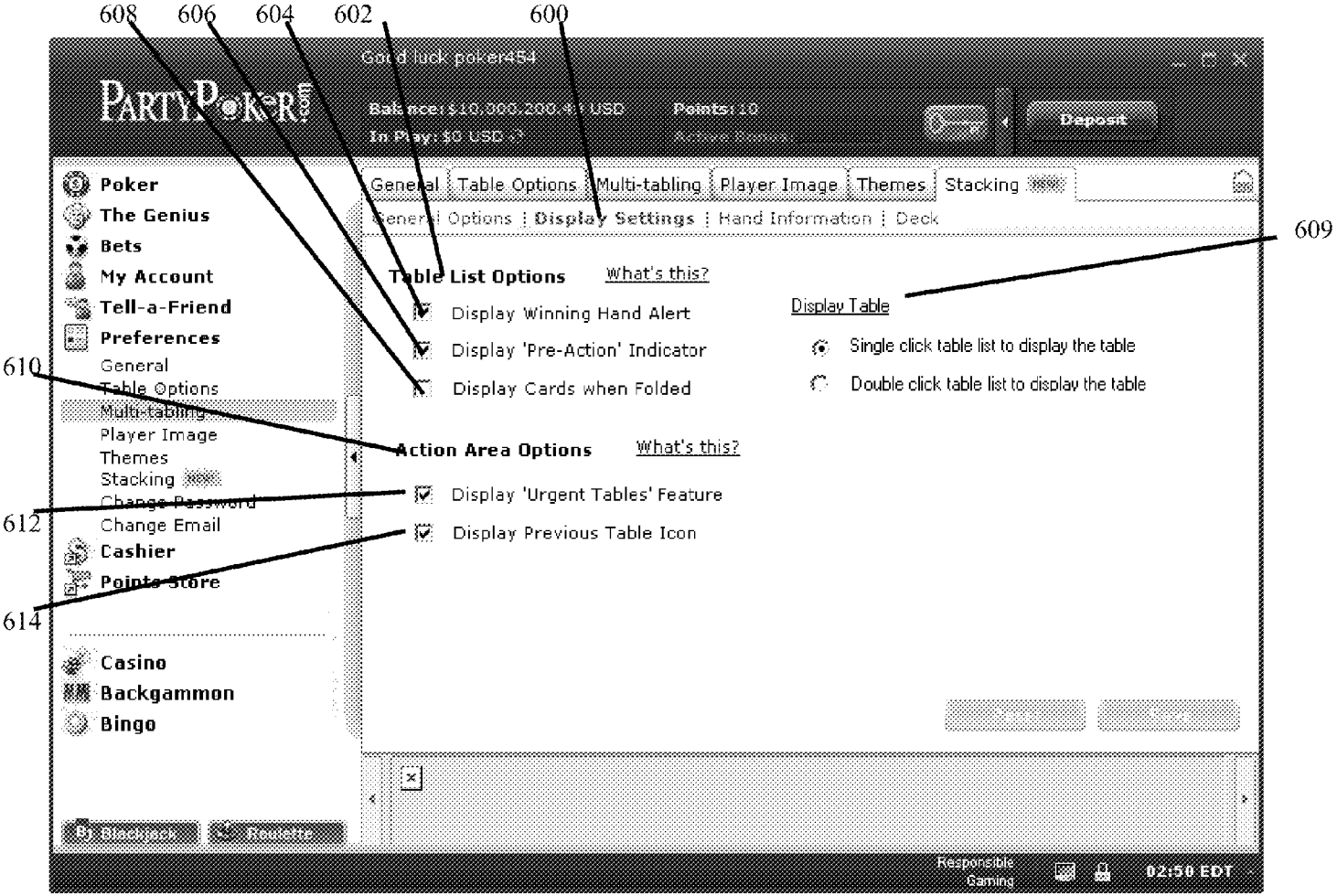
FIG. 40 is a screenshot displaying exemplary user-modifiable display options.

Display Settings:

Turning to FIG. 40, display specific settings 600 may be selected for several sub-components, including the Table List component 110 and the Action Area component 400.

With respect to the table list settings 602, the following preferences may be set:

Display Winning Hands 604: This displays the hands that a player wins.

Display 'Pre-Action' Indicator 606: This allows players to turn off the pre-action indicator which many players may find distracting.

Display Cards when Folded 608: Many players do not want to see ANY cards of a hand that they are no longer in as they have folded or are sitting out, so the default may be that this option is turned off. When turned off, the Hole and Community cards will not appear in the table list component 110. When turned on, the hole cards 38 (slightly transparent) and community cards 40 may be shown in the table list. In addition, the Console 100 may show the hole cards and community cards slightly transparent with the text 'Hand Folded' in the Hand Strength area. The Community cards 40 may appear in the console even if the show folded cards is turned off, but they may not appear in the table list component 110.

Display Table Options 609: This option may dictate the behavior when a player clicks in the list control. Selecting a single click option may bring the table into focus. Alternatively, the user may select a double or multiple click option. When selected, this option means that a single click only may display the table in the Stacking Console 100 while keeping the actual table display 20 "hidden," i.e., it may update only the Stacking Console 100. In addition, if the user clicks multiple times, that action may both bring the table to the front of the stack, in front of the other tables, and update the Stacking Console 100.

With respect to the action area settings 610, the following preferences may be set:

Display 'Urgent Tables' Feature 612: The default may be that this feature is turned on, displaying the urgent tables timer 420 discussed above. When turned off, the feature will simply not be available, and an empty space may appear in its place. In addition, the action buttons may be centered in the action area 400.

Display Previous Table Icon 614 (appears above the Urgent Table section or to the side of the Action Area 400 if the Urgent Table option 612 is turned off): The default may be that this feature is turned on, displaying the previous table icon 416 discussed above. When turned off, the feature will simply not be available and an empty space may appear in its place.

Figure 41:
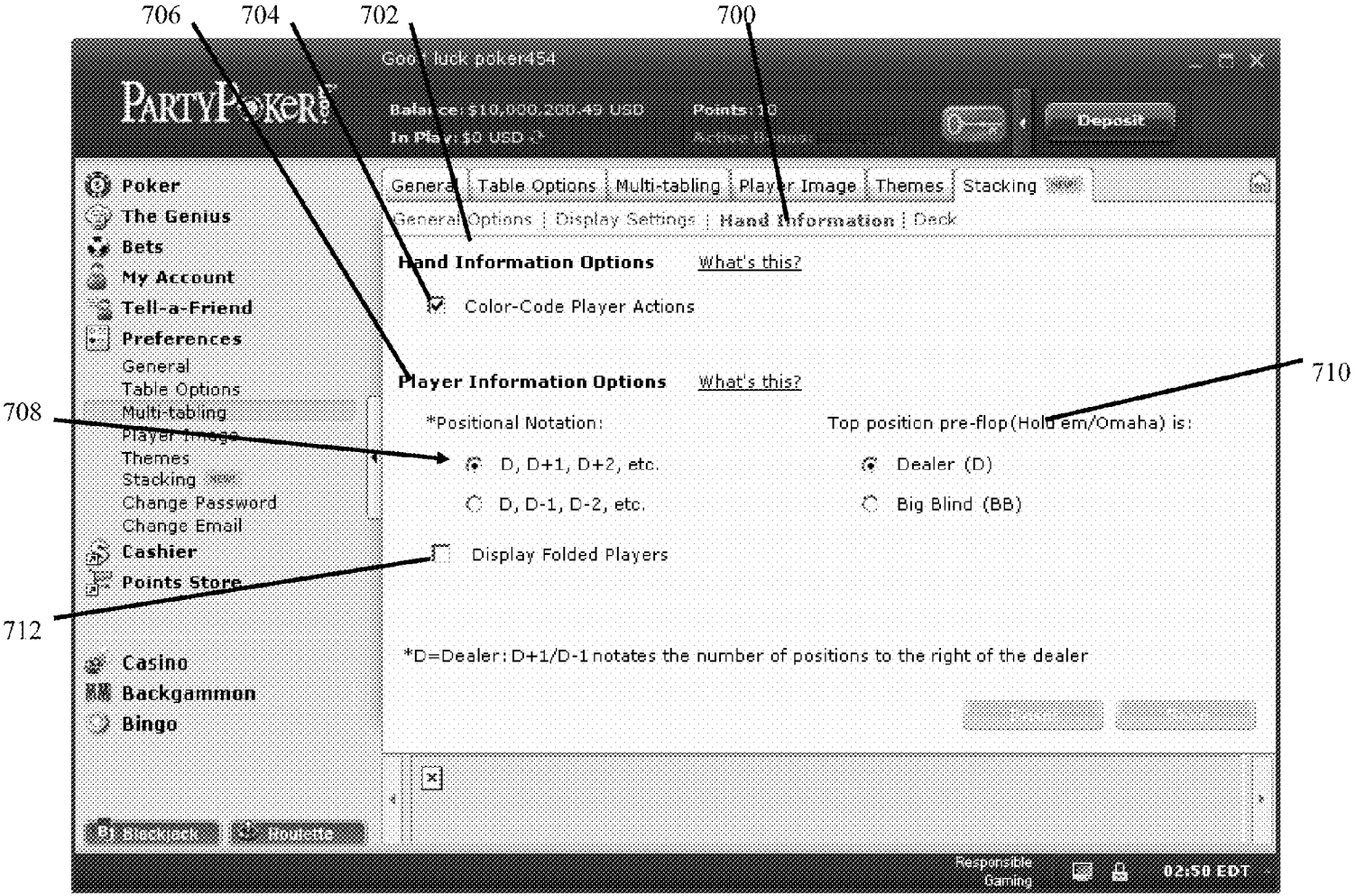
FIG. 41 is a screenshot displaying exemplary user-modifiable hand history options.

Hand Information:

This tab 700 deals with the hand 'history' settings whether overall for the hand or details for that player. See, e.g., FIG. 41.

With respect to the hand information options settings 702, the following preference may be set:

Color-Code Player Actions 704: When selected, this causes the system 10 to display the actions on the Hand History in color-coded form. If turned off, all text may be in black.

With respect to the player information options settings 706, the following preferences may be set:

Positional Notation 708: Some players prefer to see the players at a table arranged D+1 (plus) and others D−1 (minus). This option enables the player to choose his or her preferred notation, with 'D−1, D−2, etc.' being the default.

Top Position pre-flop 710 (Hold'em/Omaha): The Dealer may be at the top pre-flop as default. If the player chooses BB at the top pre-Flop, the positioning will change post-flop. In Stud, the players are displayed as per their position to act per the street, which can change based on the cards dealt.

Display Folded Players 712: If this option is checked, any folded players will be displayed in order of when they folded. The last player to fold may be displayed just below last active player still in the hand. The default may be OFF as most players will not want to see any details of players that have folded.

Figure 42:
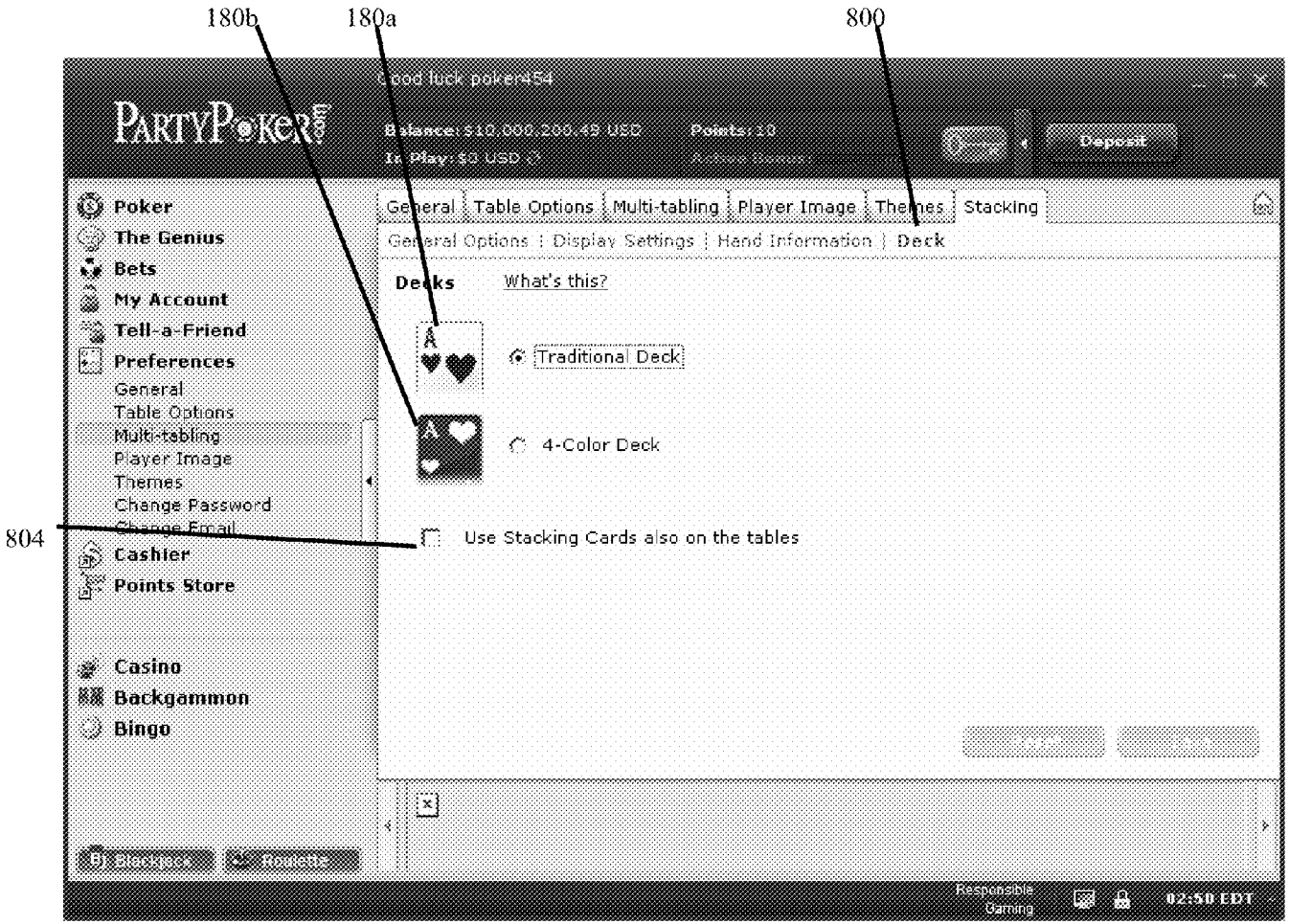
FIG. 42 is a screenshot displaying exemplary user-modifiable deck options.

Deck:

Turning to FIG. 42, this tab 800 may allow players to choose the deck they wish to use in the stacking component and allow them to use that same deck on the table/console 21 also.

Both the table list 110 and console 100 sub-components may include card displays 180, 182. Different displays or decks may be available to the player, but each card in each deck should easily and readily convey to the user that card's suit and value.

Figure 25:
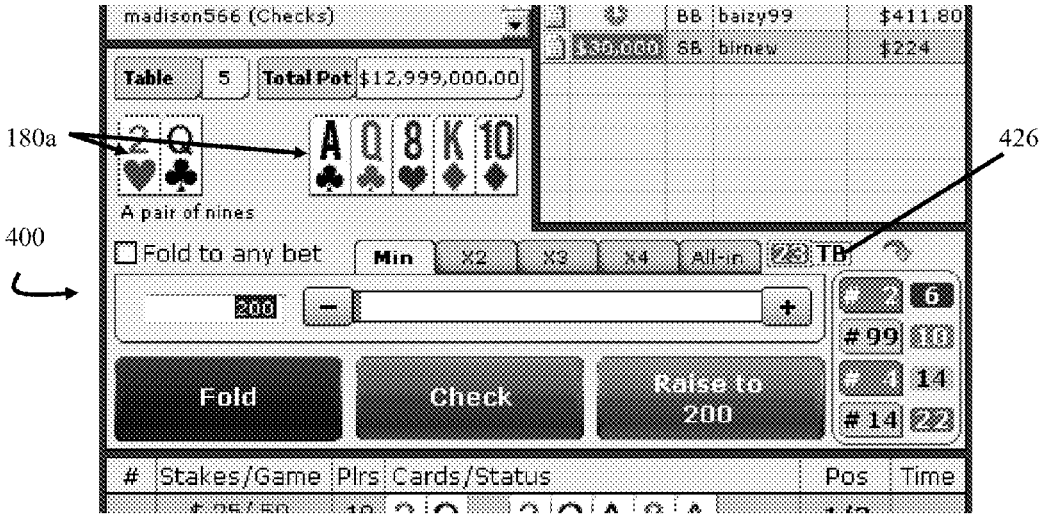
FIG. 25 is a screenshot of an exemplary action area sub-component that includes a timebank indicator.

Deck 1—Traditional: As seen in FIG. 25, this deck **180*a*** will be based on a traditional deck, visually displaying the card's suit and number/letter.

Deck 2—Simple: This deck **180*b* has a 4 color card option only and no suits, just numbers and letters, as seen in FIG. 24. The colors may be used to represent the various suits, and this deck 180*b*** may be particularly well-suited to frequent players that can determine their hands quickly with simple visual recognition.

Painting vs. Images: The decision to paint the images manually or to use a strip of images may be made based on performance of the system. If images are used, the images preferably may be JPGs if performance is deemed to be higher. This may avoid the calling of the rendering engine, which may be inefficient for PNGs.

Preferably, the system 10 may place a gap or separator between hole cards and community cards. In Stud games, the system may place separators between the 2 first down-turned cards, the 4 upturned cards, and the final down-turned card.

Silent Downloading: If the stacking system 10 is installed as an upgrade to a current system, preferably, the stacking decks will be silently downloaded. That is, they may not be included as part of the main download as they do not have primary functionality.

Use Stacking Cards also on the Tables 804: Players likely will want to use the same deck on the table as they have on the stacking component to reduce processing time and reduce mistakes. As such, the system preferably will display the same deck both on the table 20 on the console 21 and in the stacking component 30. In addition, changes to the deck, e.g., to the card backs or to the type of deck selected, may be reflected on both the console and the stacking component. When the Traditional deck is chosen and this option is checked, the Traditional deck may be used on the tables. When the 4-Color Deck is chosen and this option is checked, this deck may be used in place of their chosen deck. If the player has this option 804 checked and tiles tables without using the stacking component (not opened) but then opens up the stacking component, the cards immediately may change to those selected for the stacking component.

Client side storage for preferences: The preferences for the stacking component may be stored client side. This may make it easier for the system 10 to get the details of the preferences for instrumentation purposes. In addition, if a player has two machines, the stacking may be set up for each of the machines individually. In this case, the player need not adjust his or her settings each time he or she switches from one machine to another.

Keyboard Shortcuts

Keyboard shortcuts may be available for the player to take actions in the action area of both the Large Stacking component 30*a* AND the Small Stacking component 30*b*. In addition, the system 10 may allow the user to Tab between the Action component 400 and the List component 110, e.g., using CTRL+Tab. When in the List component 110, the system 10 further may allow the user to scroll through the list, e.g., using the up and down arrows.

Menu Options

Figure 43:
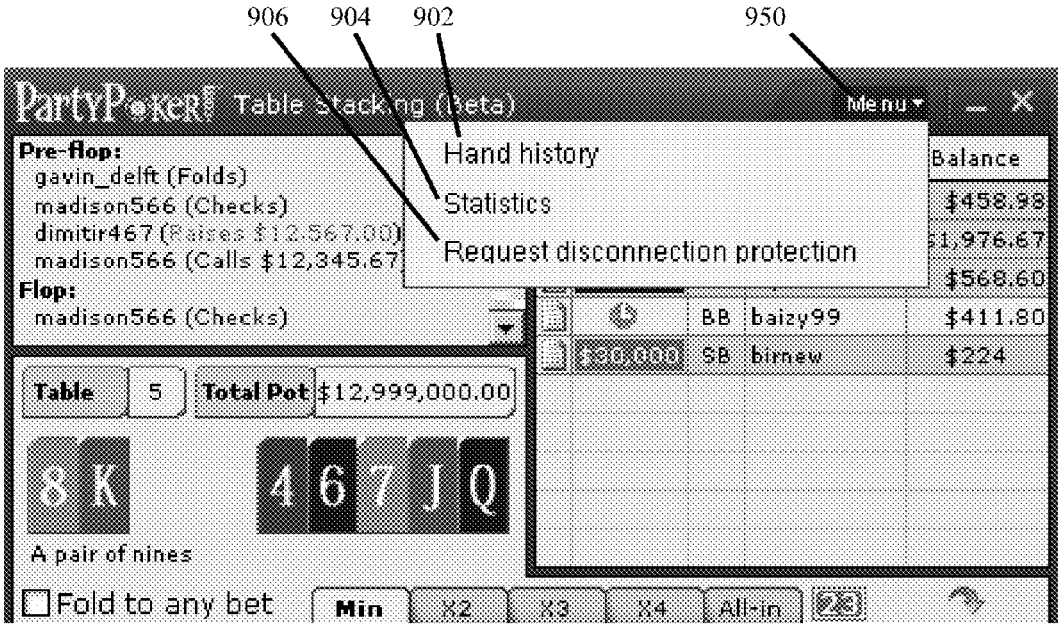
FIG. 43 is a screenshot of an exemplary menu option overlaid on a stacking component.

Each table stacking component may have a menu option 900, allowing the user to implement table features as if the functionality was on the table in question and accessed from the table menu, as seen in FIG. 43.

The Hand history option 902 may display the Instant Hand History Dialog for the table active in the Console 21. This Statistics option 904 may display a Statistics Dialog including, e.g., session start time, hands played, hands won, and showdowns won. The Request disconnection protection option 906 may activate a request for DP (Disconnect Protects) for the active table in the Console 21.

Figure 44:
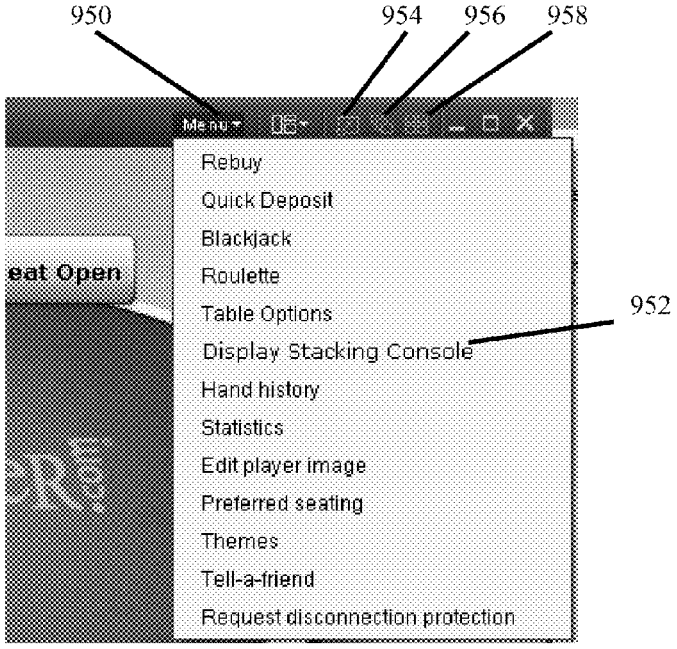
FIG. 44 is a screenshot of an exemplary menu option overlaid on a table.

Conversely, each active table may have a menu option 950, and the table stacking component 30 may be launched by selecting a "Display Stacking Console" option 952 in that menu, as seen in FIG. 44. Alternatively, the table may have a stacking icon 954 displayed directly on each table, whereby clicking the icon 954 stacks all open tables and launches the table stacking component.

System Components

Figure 46:
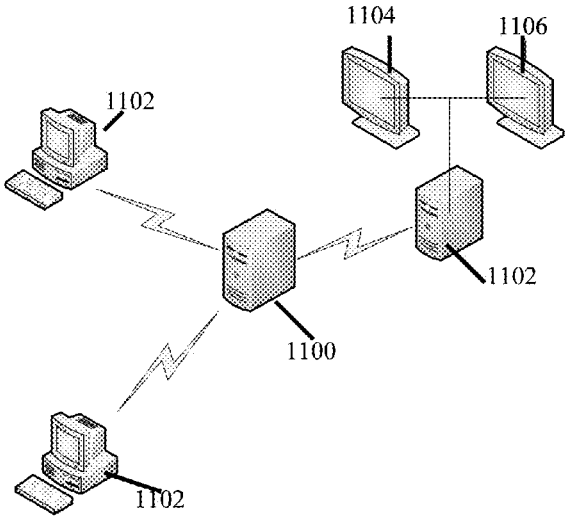
FIG. 46 is an exemplary schematic of a network on which a stacking system may operate.

Turning to FIG. 46, the stacking system may rely on the interaction of the following components.

Game Server 1100—a server component that hosts the tables and game play. The server 1100 also may provide a number of services like player login, player registration, player logout, player search etc.

Client 1102—the user interface to the gaming system through which a user can join one or more tables and play on them. The client 1102 may be downloaded to, or otherwise installed on, each player's system/computer and may reside on that system. Here, the client 1102 may refer to the player's system or to the application(s) residing on that system. Each client 1102 may include the following sub components:

Table 20: One or more tables that currently are being played on the system. Each table preferably shows up-to-date information on the players that are seated at that table, along with information about each player such as their balances, hand details, etc.

Stacking Window 30: This includes a table list and also may include a bottom panel. Table list shows all the tables that the user has opened, and the bottom panel shows the hand information for the selected table. The stacking window may be a resizable, separate window. In one embodiment, it is displayed to a user, e.g., on a computer monitor 1104, attached to the right hand side of a game table. However, the window may be movable to any part of the player's screen.

Minimum System Requirements

In one embodiment, a table stacking implementation may require at least the following system configuration to operate: RAM: 256 MB, Hard Disk: 4 GB, OS: Windows 98 onwards with IE 6.0, Monitor Resolution: 1024×768. Exemplary products that may incorporate a table stacking window may include: Party Poker (both downloaded and non-downloaded client versions), Partypoker.it, Partypoker.net, ITV Poker, Gamebookers Poker, Intralot Poker, and Cirsa Poker, although a table stacking functionality may be beneficial in other applications.

Implementation details

The table stacking window 30 may keep references for each table that a user opens and may add a row in its table list 110 each time the user opens another table. When a table is opened, the table registers with the stacking window 30, and when a table is closed, it unregisters with stacking window. Thus, the stacking window preferably contains the list of all user-opened tables 20 on the system.

When in the stacking window 30, if the user double clicks on a table list row 112, the corresponding table is brought to the top of the console area 21 and/or brought into focus. When the user right clicks on the table list row 112, the system 10 may check if there are any options buttons to be displayed for the player and if so, the option button popup may be shown. When the user clicks on the option button, the user may be redirected to the corresponding table, and the system may act as if the user had clicked on the option buttons on the table, sending this information to the server. When there is any change in the status of a table, like a change in dealer position, the table notifies the stacking window 30 about the same. The stacking window 30 then updates the position for the corresponding table on the table list.

By default, the tables may be stacked on top of each other, although the player has the option of arranging the tables in whatever configuration he or she desires. The table with the most urgent action, i.e., the table requiring the player to act and with the least time comparative to other tables open and available to act, may jump to the front of stack if this preference is selected and thus be in focus. Preferably, this table will stay in focus until the player has acted at that table or has run out of time to make an action on that table.

Table Stacking Behavior

The client may need to measure the screen resolution. If the screen size is not supported the stacking icon may be grayed out, and attempts to launch the stacking function may display a message explaining that the function is not supported at this resolution.

As further tables are opened, they may be stacked on top of each other in the same screen space/console area 21, thus stacked on top of each other. In one embodiment, the last table to be opened may be placed at the top of the stack. In another embodiment, the table with the most urgent action, i.e., the least time to act, may be placed on top of the stack. In this embodiment, if the table with the most urgent action times out, then the next window should pop to the front and become active.

In still another embodiment, if the player is in the process of sitting down at a table, then that table may stay on top until the player has been seated, taking precedence over the table with the most urgent action.

Resizing

The player may be able to resize the tables in the console area 21 with its window detached.

Moving Tables

If the player moves a table in console area 21, the other tables preferably stay where they are. In addition, if a player moves a table it may snap to the front in the position in which it is placed.

Multi Monitor Option

By default, the system 10 may open the tables 20 and the stacking component 30 on a first monitor 1104 if more than one monitor is available. If the user moves a first table to a second monitor 1106 and has stacking selected, then all tables opened after the first table preferably may be stacked underneath the first table. Similarly, wherever the first table may be positioned, any subsequent tables opened may be stacked in the same position. If the player then moves the first table or any of the other tables, the table remains where the user places it and should pop to the front where it is positioned by the player.

Switching between Stacking, Cascading and Tiling

The system 10 allows the user to alternate between stacking, cascading and/or tiling in order to view multiple open tables in a variety of ways. To switch between the various views, the system may include toggle or selection icons.

If a player is in stacking mode and presses a cascade icon 956, the tables should cascade, and the stacking window 30 preferably closes. If a player is in stacking mode and selects the tile option icon 958, the tables should be tiled, and the stacking window 30 preferably closes.

Conversely, if a player is in cascade mode and selects the stacking mode icon 954, the tables should stack on the first monitor, and the stacking window 30 should open, e.g., to the right of the table console area 21. If a player is in tile mode and presses stack mode icon 954, the tables may stack on the first monitor, and the stacking window 30 should open, e.g., to the right of the table console area 21.

Focus rules

The system 10 may provide the user with the option of displaying the table with the least time to act on top in the table list. When the player selects stacking mode, the system 10 may present the player with an overlay to warn that, by default, the table taking focus will remain in focus until action is done while using stacking mode, and this may cause other tables to timeout.

Other Functionality

The player may be able to sort the columns 114 of the table subcomponent 110 by left clicking on one or more of the various columns 114 or on the headers of those columns 114.

The player may be able to right click on a row 112 to display and use pre-bet options to make an action. The pre-bet buttons may display if the timer is not running on that table. Otherwise, the action button may be appropriate. For raises, the player may be able to enter an amount to bet and then submit the bet by pressing the raise button.

The player may be able to close the stacking component window 30 by clicking the close "X."

Newly opened tables may stay in focus for a predetermined amount of time, e.g., about 5 seconds, to allow the player to sit down at the table. Additionally, the ability to select a post blind option or wait for big blind option may be provided in the stacking console to allow a player to sit down faster.

The stacking component 30 may be located on a display independent of the one displaying the tables. When tables are resized and the player has the stacking component 30 snapped to the side of the tables, the stacking window 30 may detach from the side of the table and stay in its current position. In addition, if the player selects a table or another document, the stacking component may lose focus, may become an inactive window, or may be covered by the table or other document.

Figure 45:
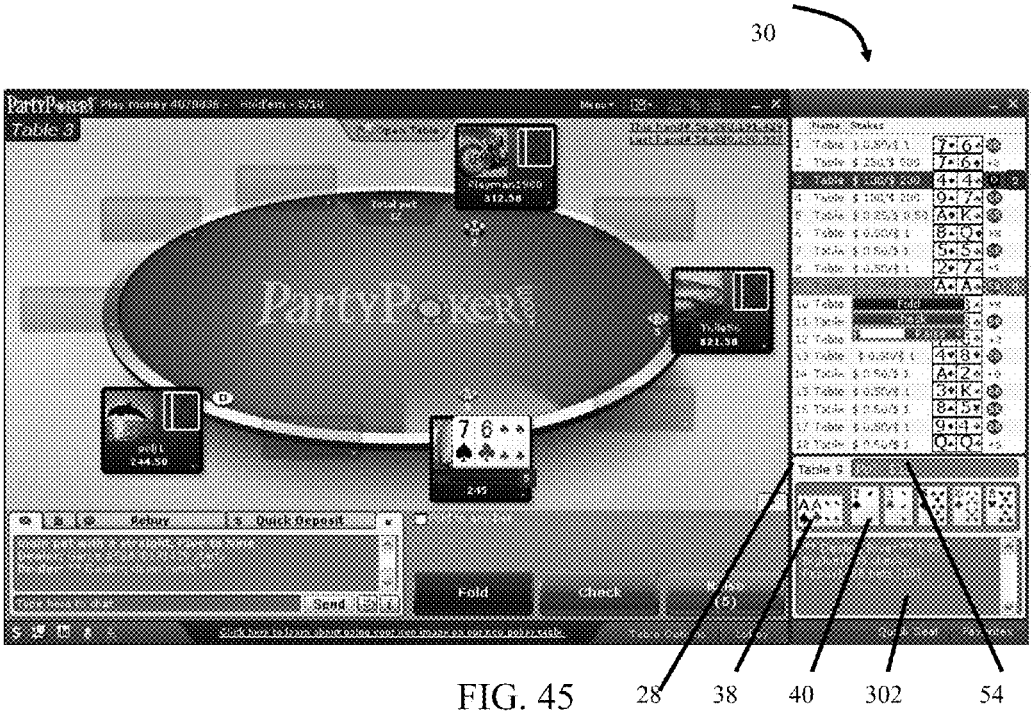
FIG. 45 is a screenshot of another embodiment of a stacking component displayed alongside a table.

In another embodiment of the table stacking component 30, when the player right clicks on a row 112, the details for that table may be displayed at the bottom of the table list. As seen in FIG. 45, these details may include the table number 28, the pot 54 for that table, the player's hole cards 38, the community cards 40, and/or the hand strength. In addition, the dealer chat 302 may be displayed in a window below the table list, and any player alerts that have been set that get triggered may be highlighted in the color that is used to highlight the table.

Internationalization Requirements

All features preferably are multilingual by default. Graphical elements may have no or very limited text to simplify localization, and text may be rendered programmatically where possible to reduce resources required for maintenance.

In addition, each user interface may contain adequate room for text expansion, e.g., about 20-30% to accommodate for different word lengths when translating into other languages. Similarly, there may be vertical space allowances for diacrits (accented ãéúí) in both lower and upper case form or Asian language characters where required.

Method for Using Table Stacking Component

The following method is one way in which the table stacking component may be employed:

Receive a request or prompt to open one or more tables.

Receive a request or prompt to sit down at at least one of the tables or to join a waitlist for the table or tables.

Instruct or receive a request from the user to select the option of auto posting blinds, which may get the user into the game more quickly and reduce pop-ups.

Receive a request to use the stacking system 10, e.g., by recognizing the selection of a stacking icon 954. Then, the tables may stack on top of each other and the stacking window may open.

The stacked tables may be moved around on the screen or display by the user. To then restack the table, the user simply may press the stacking icon 954 again.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A process operable on one or more computers for arranging a plurality of game tables, said tables including changing information, comprising:

displaying an active table;

displaying a stacking component that provides at least a subset of said changing information about each of said plurality of game tables;

updating said changing information on said tables; and updating said subset on said stacking component as said changing information changes;

wherein said stacking component includes a grid for organizing and displaying information pertaining to said plurality of game tables;

and further wherein said stacking component is configured such that selecting a row corresponding to one of said tables displays said table.

2. A process according to claim 1, wherein said stacking component includes alerts to tables for which action is required.

3. A process according to claim 2, wherein said alerts are displayed in a table list sub-component.

4. A process according to claim 1, wherein said stacking component includes a player information sub-component.

5. A process according to claim 1, wherein said stacking component includes at least one of a hand information sub-component and an action area sub-component.

6. A process according to claim 1, wherein said grid includes a row of headers corresponding to different subsets of information about each of said tables, and further wherein selecting a header arranges said tables in said grid according to said header.

7. A process according to claim 1, further comprising displaying an active table indicator in said stacking component.

8. A process according to claim 1, further comprising displaying a timer in said stacking component, said timer including a table number and time to act for a corresponding table.

9. A system for organizing a plurality of electronic game tables, comprising:

a game server in communication with a plurality of remote client computers;

each of said remote client computers including a display; and at least one display including a console area and a stacking component area, wherein said console area displays an active table, wherein said stacking component area aggregates and displays information about said plurality of electronic game tables, and further wherein said stacking component presents a player with information pertaining to each of said tables and allows said player to select a table, make it an active table, and display said table in said console area.

10. A system according to claim 9, said stacking component area comprising:

a table list sub-component; and a player information sub-component.

11. A system according to claim 10, said stacking component area further comprising at least one of:

a hand information sub-component and an action area sub-component.

12. A system according to claim 9, wherein said stacking component:

allows said player to act on a non-active table without displaying said non-active table in said console area.

13. A system according to claim 9, wherein said stacking component displays information about a table not displayed in said console area, and further wherein a portion of said displayed information changes before each hand played at said table and a second portion of said displayed information changes dynamically as each hand is played at said table.

14. A system according to claim 9, wherein a player may alternate between stacking, cascading, and tiling views of said plurality of electronic game tables.

15. A system according to claim 9, wherein said stacking component area is detachable from said console area or movable with respect to said console area.

16. An electronic game table stacking component, comprising:

a table list sub-component and a player information sub-component;

said table list sub-component including a grid for displaying a plurality of categories of information about a plurality of game tables opened by a player;

said player information sub-component including information about a plurality of players at a selected one of said plurality of game tables;

wherein said table list sub-component includes an indicator for said selected one of said plurality of game tables; and wherein said stacking component includes an indicator notifying said player of tables for which action is needed and displaying a relative priority for said tables.

17. An electronic game table stacking component according to claim 16, wherein said stacking component allows a player to act indirectly on a desired table by taking action in said stacking component.

18. An electronic game table stacking component according to claim 16, further comprising a hand information component.

19. An electronic game table stacking component according to claim 16, further comprising an action area component.

20. An electronic game table stacking component according to claim 16, said stacking component linked to a console area, said console area displaying an active game table.

21. An electronic game table stacking component according to claim 16, wherein said plurality of categories of information displayed in said table list sub-component includes a plurality of:

number of players seated;

type of game being played;

stakes involved;

player's position in the hand;

time remaining to act;

hole cards; and community cards.

* * * * *